US009840908B2

(12) United States Patent
Patel et al.

(10) Patent No.: US 9,840,908 B2
(45) Date of Patent: Dec. 12, 2017

(54) COMPLETION SYSTEM HAVING A SAND CONTROL ASSEMBLY, AN INDUCTIVE COUPLER, AND A SENSOR PROXIMATE TO THE SAND CONTROL ASSEMBLY

(71) Applicant: SCHLUMBERGER TECHNOLOGY CORPORATION, Sugar Land, TX (US)

(72) Inventors: Dinesh R Patel, Sugar Land, TX (US); Donald W Ross, Houston, TX (US); Anthony Veneruso, Sugar Land, TX (US); Fabien Cens, Igny (FR); John Lovell, Houston, TX (US); Jean-Phillippe Beaulieu, Montreuil (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 312 days.

(21) Appl. No.: 14/586,375

(22) Filed: Dec. 30, 2014

(65) Prior Publication Data

US 2015/0315895 A1 Nov. 5, 2015

Related U.S. Application Data

(62) Division of application No. 12/767,290, filed on Apr. 26, 2010, now abandoned, which is a division of application No. 11/688,089, filed on Mar. 19, 2007, now Pat. No. 7,735,555.

(60) Provisional application No. 60/787,592, filed on Mar. 30, 2006, provisional application No. 60/745,469, filed on Apr. 24, 2006, provisional application No. 60/747,986, filed on May 23, 2006, provisional (Continued)

(51) Int. Cl.

| | |
|---|---|
| ***E21B 43/08*** | (2006.01) |
| ***E21B 47/12*** | (2012.01) |
| ***E21B 17/02*** | (2006.01) |
| ***E21B 43/14*** | (2006.01) |
| ***E21B 47/00*** | (2012.01) |

(52) U.S. Cl.

CPC ..... *E21B 47/12* (2013.01); *E21B 17/028* (2013.01); *E21B 43/08* (2013.01); *E21B 43/14* (2013.01); *E21B 47/00* (2013.01); *E21B 47/122* (2013.01)

(58) Field of Classification Search

CPC ..... E21B 43/08; E21B 47/12

USPC ..... 166/278, 66, 235, 236

See application file for complete search history.

(56) References Cited

U.S. PATENT DOCUMENTS 3,595,257 A * 7/1971 McMahon ..... H01B 7/045 137/1

5,119,089 A * 6/1992 Khalil ..... G01V 1/201 175/40

(Continued)

*Primary Examiner* — Kenneth L Thompson

(57) ABSTRACT

A completion system for use in a well includes a first completion section and a second section. The first completion section has a sand control assembly to prevent passage of particulates, a first inductive coupler portion, and a sensor positioned proximate to the sand control assembly that is electrically coupled to the first inductive coupler portion. The second section is deployable after installation of the first completion section. It includes a second inductive coupler portion to communicate with the first inductive coupler portion, to enable communication between the first completion section's sensor and another component coupled to the second section.

23 Claims, 31 Drawing Sheets

Related U.S. Application Data application No. 60/805,691, filed on Jun. 23, 2006, provisional application No. 60/865,084, filed on Nov. 9, 2006, provisional application No. 60/866,622, filed on Nov. 21, 2006, provisional application No. 60/867,276, filed on Nov. 27, 2006, provisional application No. 60/890,630, filed on Feb. 20, 2007.

(56) References Cited

U.S. PATENT DOCUMENTS 5,925,879 A * 7/1999 Hay ..... E21B 33/1243 250/227.14
6,108,267 A * 8/2000 Pearce ..... G01V 1/201 174/101.5
6,554,064 B1 * 4/2003 Restarick ..... E21B 17/003 166/227
6,983,796 B2 * 1/2006 Bayne ..... E21B 17/003 166/235
7,165,892 B2 * 1/2007 Grigsby ..... E21B 17/028 346/33 A
7,191,832 B2 * 3/2007 Grigsby ..... E21B 17/026 166/278
7,213,650 B2 * 5/2007 Lehman ..... E21B 37/08 166/177.6
7,712,524 B2 * 5/2010 Patel ..... E21B 17/028 166/242.6
7,735,555 B2 * 6/2010 Patel ..... E21B 17/028 166/227
7,793,718 B2 * 9/2010 Patel ..... E21B 17/028 166/227
7,896,070 B2 * 3/2011 Lovell ..... E21B 33/1208 166/179
7,896,079 B2 * 3/2011 Dyer ..... E21B 43/14 166/105
8,056,619 B2 * 11/2011 Patel ..... E21B 17/028 166/242.7
8,082,983 B2 * 12/2011 Patel ..... E21B 17/028 166/205
8,082,990 B2 * 12/2011 Lovell ..... E21B 17/028 166/242.6
8,096,354 B2 * 1/2012 Poitzsch ..... E21B 43/26 166/250.01
8,235,127 B2 * 8/2012 Patel ..... E21B 17/028 166/242.6
8,312,923 B2 * 11/2012 Patel ..... E21B 17/028 166/250.01
8,988,178 B2 * 3/2015 Deville ..... E21B 17/028 336/115
9,175,523 B2 * 11/2015 Patel ..... E21B 17/028
2005/0028983 A1 * 2/2005 Lehman ..... E21B 28/00 166/311
2011/0241897 A1 * 10/2011 Haynes ..... E21B 43/04 340/854.5
2014/0251679 A1 * 9/2014 Rogers ..... G01V 11/002 174/541

* cited by examiner

COMPLETION SYSTEM HAVING A SAND CONTROL ASSEMBLY, AN INDUCTIVE COUPLER, AND A SENSOR PROXIMATE TO THE SAND CONTROL ASSEMBLY

CROSS-REFERENCE TO RELATED APPLICATIONS

This claims the benefit under 35 U.S.C. §119(e) of the following provisional patent applications: U.S. Ser. No. 60/787,592, entitled "Method for Placing Sensor Arrays in the Sand Face Completion," filed Mar. 30, 2006; U.S. Ser. No. 60/745,469, entitled "Method for Placing Flow Control in a Temperature Sensor Array Completion," filed Apr. 24, 2006; U.S. Ser. No. 60/747,986, entitled "A Method for Providing Measurement System During Sand Control Operation and Then Converting It to Permanent Measurement System," filed May 23, 2006; U.S. Ser. No. 60/805,691, entitled "Sand Face Measurement System and Re-Closeable Formation Isolation Valve in ESP Completion," filed Jun. 23, 2006; U.S. Ser. No. 60/865,084, entitled "Welded, Purged and Pressure Tested Permanent Downhole Cable and Sensor Array," filed Nov. 9, 2006; U.S. Ser. No. 60/866,622, entitled "Method for Placing Sensor Arrays in the Sand Face Completion," filed Nov. 21, 2006; U.S. Ser. No. 60/867,276, entitled "Method for Smart Well," filed Nov. 27, 2006; and U.S. Ser. No. 60/890,630, entitled "Method and Apparatus to Derive Flow Properties Within a Wellbore," filed Feb. 20, 2007, and U.S. Ser. No. 12/767,290, entitled "Completion System Having A Sand Control Assembly, An Inductive Coupler, And Sensor Proximate To The Sand Control Assembly," filed Apr. 26, 2010. Each of the above applications is hereby incorporated by reference.

TECHNICAL FIELD

The invention relates generally to a completion system having a completion section that has a sand control assembly to prevent passage of particulate material, an inductive coupler, and a sensor positioned proximate to the sand control assembly and electrically connected to the inductive coupler portion.

BACKGROUND

A completion system is installed in a well to produce hydrocarbons (or other types of fluids) from reservoir(s) adjacent the well, or to inject fluids into the well. Sensors are typically installed in completion systems to measure various parameters, including temperature, pressure, and other well parameters.

However, deployment of sensors is associated with various challenges, particularly in wells where sand control is desirable.

SUMMARY

In general, a completion system for use in a well includes a first completion section having a sand control assembly to prevent passage of particulate material, a first inductive coupler portion, and a sensor positioned proximate to the sand control assembly and electrically coupled to the first induction coupler portion. A second section is deployable after installation of the first completion section, where the second section includes a second inductive coupler portion to communicate with the first inductive coupler portion to enable communication between the sensor and another component coupled to the second section.

Other or alternative features will become apparent from the following description, from the drawings, and from the claims.

DETAILED DESCRIPTION

Figure 1A:
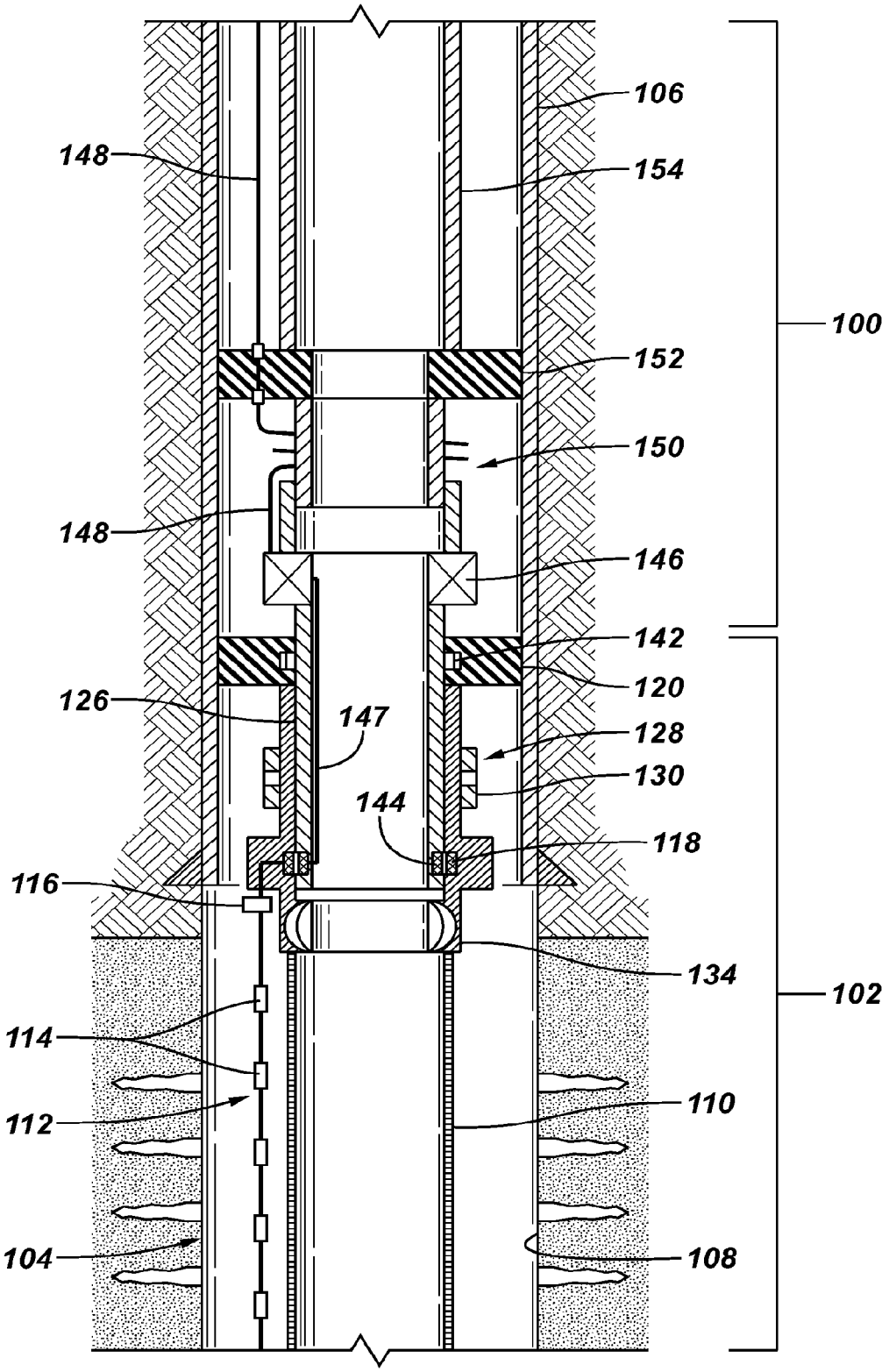
FIG. 1A illustrates a two-stage completion system having an inductively coupled wet connect mechanism for deployment in a well, in accordance with an embodiment.

In the following description, numerous details are set forth to provide an understanding of the present invention.

However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a completion system is provided for installation in a well, where the completion system allows for real-time monitoring of downhole parameters, such as temperature, pressure, flow rate, fluid density, reservoir resistivity, oil/gas/water ratio, viscosity, carbon/oxygen ratio, acoustic parameters, chemical sensing (such as for scale, wax, asphaltenes, deposition, pH sensing, salinity sensing), and so forth. The well can be an offshore well or a land-based well. The completion system includes a sensor assembly (such as in the form of a sensor array of multiple sensors) that can be placed at multiple locations across a sand face of a well in some embodiments. A "sand face" refers to a region of the well that is not lined with a casing or liner. In other embodiments, the sensor assembly can be placed in a lined or cased section of the well. "Real-time monitoring" refers to the ability to observe the downhole parameters during some operation performed in the well, such as during production or injection of fluids or during an intervention operation. The sensors of the sensor assembly are placed at discrete locations at various points of interest. Also, the sensor assembly can be placed either outside or inside a sand control assembly, which can include a sand screen, a slotted or perforated liner, or a slotted or perforated pipe.

The sensors can be placed proximate to a sand control assembly. A sensor is "proximate to" a sand control assembly if it is in a zone in which the sand control assembly is performing control of particulate material.

In some embodiments, a completion system having at least two stages (an upper completion section and a lower completion section) is used. The lower completion section is run into the well in a first trip, where the lower completion section includes the sensor assembly. An upper completion section is then run in a second trip, where the upper completion section is able to be inductively coupled to the first completion section to enable communication and power between the sensor assembly and another component that is located uphole of the sensor assembly. The inductive coupling between the upper and lower completion sections is referred to as an inductively coupled wet connect mechanism between the sections. "Wet connect" refers to electrical coupling between different stages (run into the well at different times) of a completion system in the presence of well fluids. The inductively coupled wet connect mechanism between the upper and lower completion sections enables both power and signaling to be established between the sensor assembly and uphole components, such as a component located elsewhere in the wellbore at the earth surface.

The term two-stage completion should also be understood to include those completions where additional completion components are run in after the first upper completion, such as commonly used in some cased-hole frac-pack applications. In such wells, inductive coupling may be used between the lowest completion component and the completion component above, or may be used at other interfaces between completion components. A plurality of inductive couplers may also be used in the case that there are multiple interfaces between completion components.

Induction is used to indicate transference of a time-changing electromagnetic signal or power that does not rely upon a closed electrical circuit, but instead includes a component that is wireless. For example, if a time-changing current is passed through a coil, then a consequence of the time variation is that an electromagnetic field will be generated in the medium surrounding the coil. If a second coil is placed into that electromagnetic field, then a voltage will be generated on that second coil, which we refer to as the induced voltage. The efficiency of this inductive coupling increases as the coils are placed closer, but this is not a necessary constraint. For example, if time-changing current is passed through a coil is wrapped around a metallic mandrel, then a voltage will be induced on a coil wrapped around that same mandrel at some distance displaced from the first coil. In this way, a single transmitter can be used to power or communicate with multiple sensors along the wellbore. Given enough power, the transmission distance can be very large. For example, solenoidal coils on the surface of the earth can be used to inductively communicate with subterranean coils deep within a wellbore. Also note that the coils do not have to be wrapped as solenoids. Another example of inductive coupling occurs when a coil is wrapped as a toroid around a metal mandrel, and a voltage is induced on a second toroid some distance removed from the first.

In alternative embodiments, the sensor assembly can be provided with the upper completion section rather than with the lower completion section. In yet other embodiments, a single-stage completion system can be used.

Although reference is made to upper completion sections that are able to provide power to lower completion sections through inductive couplers, it is noted that lower completion sections can obtain power from other sources, such as batteries, or power supplies that harvest power from vibrations (e.g., vibrations in the completion system). Examples of such systems have been described in U.S. Publication No. 2006/0086498. Power supplies that harvest power from vibrations can include a power generator that converts vibrations to power that is then stored in a charge storage device, such as a battery. In the case that the lower completion obtains power from other sources, the inductive coupling will still be used to facilitate communication across the completion components.

Figure 2:
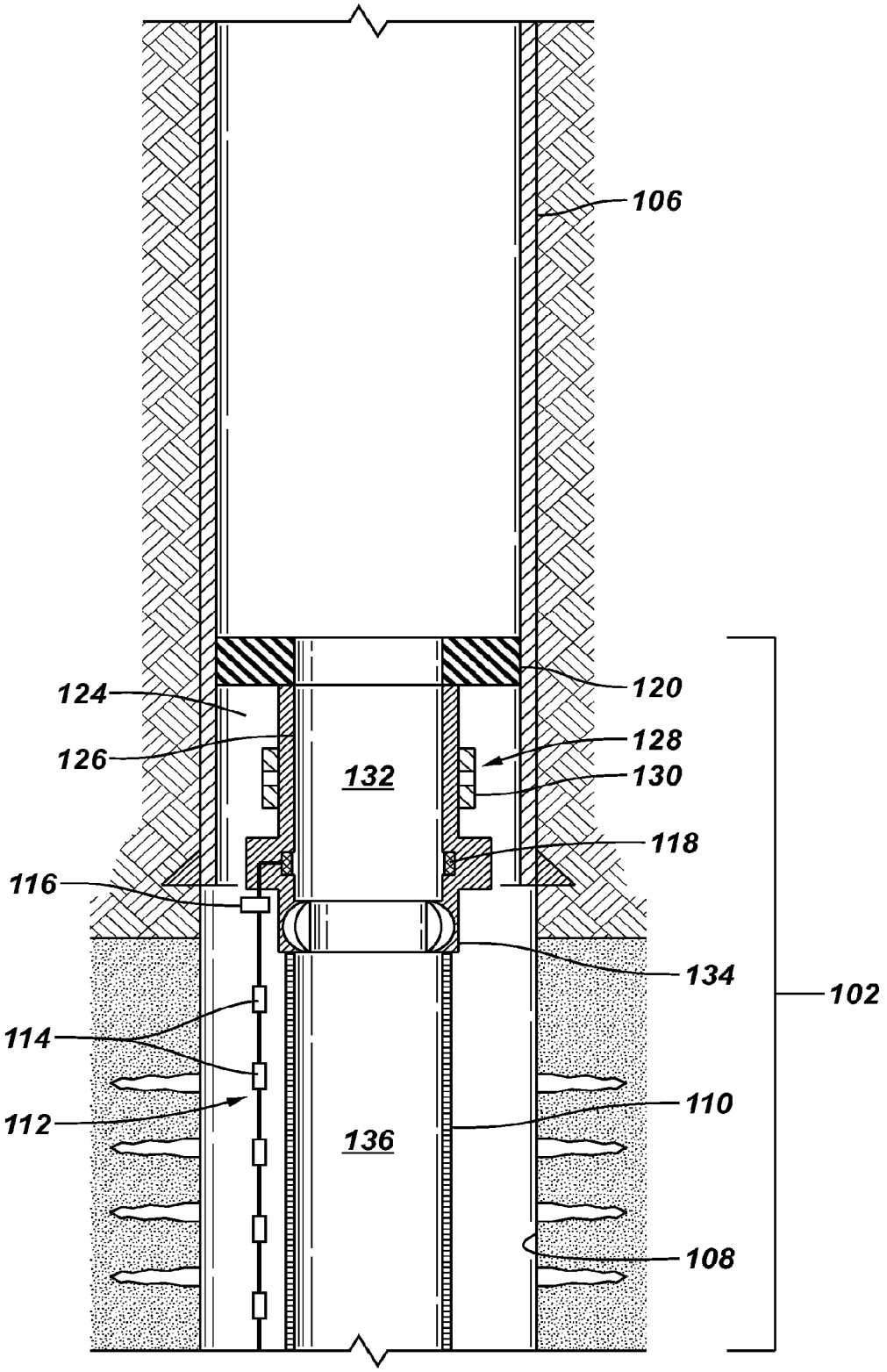
FIG. 2 illustrates a lower completion section of the two-stage completion system of FIG. 1A, according to an embodiment.
Figure 3:
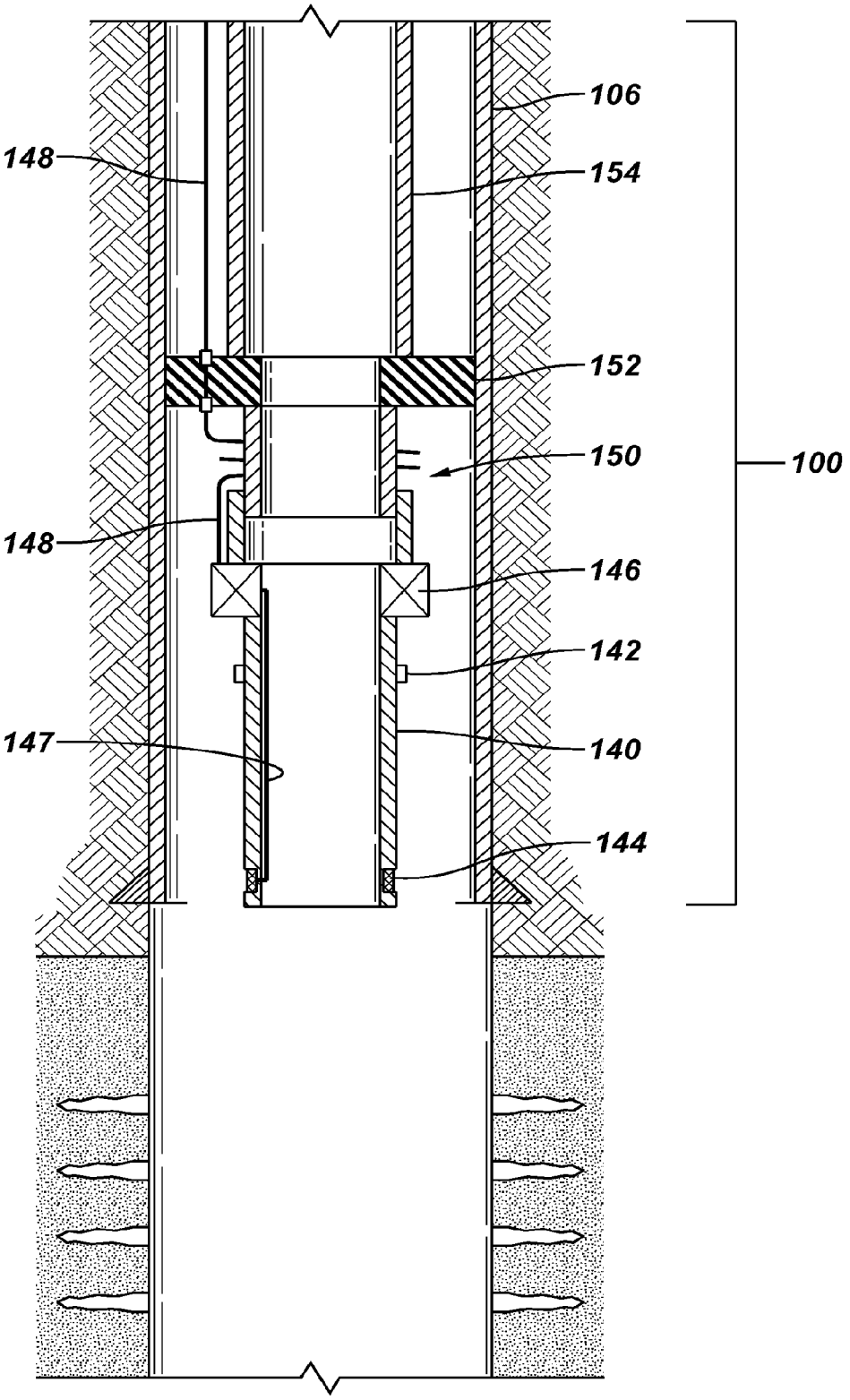
FIG. 3 illustrates an upper completion section of the two-stage completion system of FIG. 1A, according to an embodiment.

Reference is made to FIGS. 1A, 2, and 3 in the ensuing discussion of a two-stage completion system according to an embodiment. FIG. 1A shows the two-stage completion system with an upper completion section 100 (FIG. 3) engaged with a lower completion section 102 (FIG. 2).

The two-stage completion system is a sand face completion system that is designed to be installed in a well that has a region 104 that is un-lined or un-cased ("open hole region"). As shown in FIG. 1A, the open hole region 104 is below a lined or cased region that has a liner or a casing 106. In the open hole region, a portion of the lower completion section 102 is provided proximate to a sand face 108.

To prevent passage of particulate material, such as sand, a sand screen 110 is provided in the lower completion section 102. Alternatively, other types of sand control assemblies can be used, including slotted or perforated pipes or slotted or perforated liners. A sand control assembly is designed to filter particulates, such as sand, to prevent such particulates from flowing from a surrounding reservoir into a well.

In accordance with some embodiments, the lower completion section 102 has a sensor assembly 112 that has multiple sensors 114 positioned at various discrete locations across the sand face 108. In some embodiments, the sensor assembly 112 is in the form of a sensor cable (also referred to as a "sensor bridle"). The sensor cable 112 is basically a continuous control line having portions in which sensors 114 are provided. The sensor cable 112 is "continuous" in the sense that the sensor cable provides a continuous seal against fluids, such as wellbore fluids, along its length. Note that in some embodiments, the continuous sensor cable can actually have discrete housing sections that are sealably attached together. In other embodiments, the sensor cable can be implemented with an integrated, continuous housing without breaks.

In the lower completion section 102, the sensor cable 112 is also connected to a controller cartridge 116 that is able to communicate with the sensors 114. The controller cartridge 116 is able to receive commands from another location (such as at the earth surface or from another location in the well, e.g., from control station 146 in the upper completion section 100). These commands can instruct the controller cartridge 116 to cause the sensors 114 to take measurements or send measured data. Also, the controller cartridge 116 is able to store and communicate measurement data from the sensors 114. Thus, at periodic intervals, or in response to commands, the controller cartridge 116 is able to communicate the measurement data to another component (e.g., control station 146) that is located elsewhere in the wellbore or at the earth surface. Generally, the controller cartridge 116 includes a processor and storage. The communication between sensors 114 and control cartridge 116 can be bi-directional or can use a master-slave arrangement.

The controller cartridge 116 is electrically connected to a first inductive coupler portion 118 (e.g., a female inductive coupler portion) that is part of the lower completion section 102. As discussed further below, the first inductive coupler portion 118 allows the lower completion section 102 to electrically communicate with the upper completion section 100 such that commands can be issued to the controller cartridge 116 and the controller cartridge 116 is able to communicate measurement data to the upper completion section 100.

In embodiments in which power is generated or stored locally in the lower completion section, the controller cartridge 116 can include a battery or power supply.

As further depicted in FIGS. 1A and 2, the lower completion section 102 includes a packer 120 (e.g., gravel pack packer) that when set seals against casing 106. The packer 120 isolates an annulus region 124 under the packer 120, where the annulus region 124 is defined between the outside of the lower completion section 102 and the inner wall of the casing 106 and the sand face 108.

A seal bore assembly 126 extends below the packer 120, where the seal bore assembly 126 is to sealably receive the upper completion section 100. The seal bore assembly 126 is further connected to a circulation port assembly 128 that has a slidable sleeve 130 that is slidable to cover or uncover circulating ports of the circulating port assembly 128. During a gravel pack operation, the sleeve 130 can be moved to an open position to allow gravel slurry to pass from the inner bore 132 of the lower completion section 102 to the annulus region 124 to perform gravel packing of the annulus region 124. The gravel pack formed in the annulus region 124 is part of the sand control assembly designed to filter particulates.

In the example implementation of FIGS. 1A and 2, the lower completion section 102 further includes a mechanical fluid loss control device, e.g., formation isolation valve 134, which can be implemented as a ball valve. When closed, the ball valve isolates a lower part 136 of the inner bore 132 from the part of the inner bore 132 above the formation isolation valve 134. When open, the formation isolation valve 134 can provide an open bore to allow flow of fluids as well as passage of intervention tools. Although the lower completion section 102 depicted in the example of FIGS. 1A and 2 includes various components, it is noted that in other implementations, some of these components can be omitted or replaced with other components.

As depicted in FIGS. 1A and 2, the sensor cable 112 is provided in the annulus region 124 outside the sand screen 110. By deploying the sensors 114 of the sensor cable 112 outside the sand screen 110, well control issues and fluid losses can be avoided by using the formation isolation valve 134. Note that the formation isolation valve 134 can be closed for the purpose of fluid loss control during installation of the two-stage completion system.

As depicted in FIGS. 1A and 3, the upper completion section 100 has a straddle seal assembly 140 for sealing engagement inside the seal bore assembly 126 (FIG. 2) of the lower completion section 102. As depicted in FIG. 1A, the outer diameter of the straddle seal assembly 140 of the upper completion section 100 is slightly smaller than the inner diameter of the seal bore assembly 126 of the lower completion section 102. This allows the upper completion section straddle seal assembly 140 to sealingly slide into the lower completion section seal bore assembly 126 (which is depicted in FIG. 1A). In an alternate embodiment the straddle seal assembly can be replaced with a stinger that does not have to seal.

As depicted in FIG. 3, arranged on the outside of the upper completion section straddle seal assembly 140 is a snap latch 142 that allows for engagement with the packer 120 of the lower completion section 102. When the snap latch 142 is engaged in the packer 120, as depicted in FIG. 1A, the upper completion section 100 is securely engaged with the lower completion section 102. In other implementations, other engagement mechanisms can be employed instead of the snap latch 142.

Proximate to the lower portion of the upper completion section 100 (and more specifically proximate to the lower portion of the straddle seal assembly 140) is a second inductive coupler portion 144 (e.g., a male inductive coupler portion). When positioned next to each other, the second inductive coupler portion 144 and first inductive coupler portion 118 (as depicted in FIG. 1A) form an inductive coupler that allows for inductively coupled communication of data and power between the upper and lower completion sections.

An electrical conductor 147 (or conductors) extends from the second inductive coupler portion 144 to the control station 146, which includes a processor and a power and telemetry module (to supply power and to communicate signaling with the controller cartridge 116 in the lower completion section 102 through the inductive coupler). The control station 146 can also optionally include sensors, such as temperature and/or pressure sensors.

The control station 146 is connected to an electric cable 148 (e.g., a twisted pair electric cable) that extends upwardly to a contraction joint 150 (or length compensation joint). At the contraction joint 150, the electric cable 148 can be wound in a spiral fashion (to provide a helically wound cable) until the electric cable 148 reaches an upper packer 152 in the upper completion section 100. The upper packer 152 is a ported packer to allow the electric cable 148 to extend through the packer 152 to above the ported packer 152. The electric cable 148 can extend from the upper packer 152 all the way to the earth surface (or to another location in the well).

In another embodiment, the control station 146 can be omitted, and the electrical cable 148 can run from the second inductive coupler portion 144 (of the upper completion section 100) to a control station elsewhere in the well or at the earth surface.

The contraction joint 150 is optional and can be omitted in other implementations. The upper completion section 100 also includes a tubing 154, which can extend all the way to the earth surface. The upper completion section 100 is carried into the well on the tubing 154.

In operation, the lower completion section 102 is run in a first trip into the well and is installed proximate to the open hole section of the well. The packer 120 (FIG. 2) is then set, after which a gravel packing operation can be performed. To perform the gravel packing operation, the circulating port assembly 128 is actuated to an open position to open the port(s) of the circulating port assembly 128. A gravel slurry is then communicated into the well and through the open port(s) of the circulating port assembly 128 into the annulus region 124. The annulus region 124 is then filled with slurry until the annulus region 124 is gravel packed.

Next, in a second trip, the upper completion section 100 is run into the well and attached to the lower completion section 102. Once the upper end lower completion sections are engaged, communication between the controller cartridge 116 and the control station 146 can be performed through the inductive coupler that includes the inductive coupler portions 118 and 144. The control station 146 can send commands to the controller cartridge 116 in the lower completion section 102, or the control station 146 can receive measurement data collected by the sensors 114 from the controller cartridge 116.

Figure 1B:
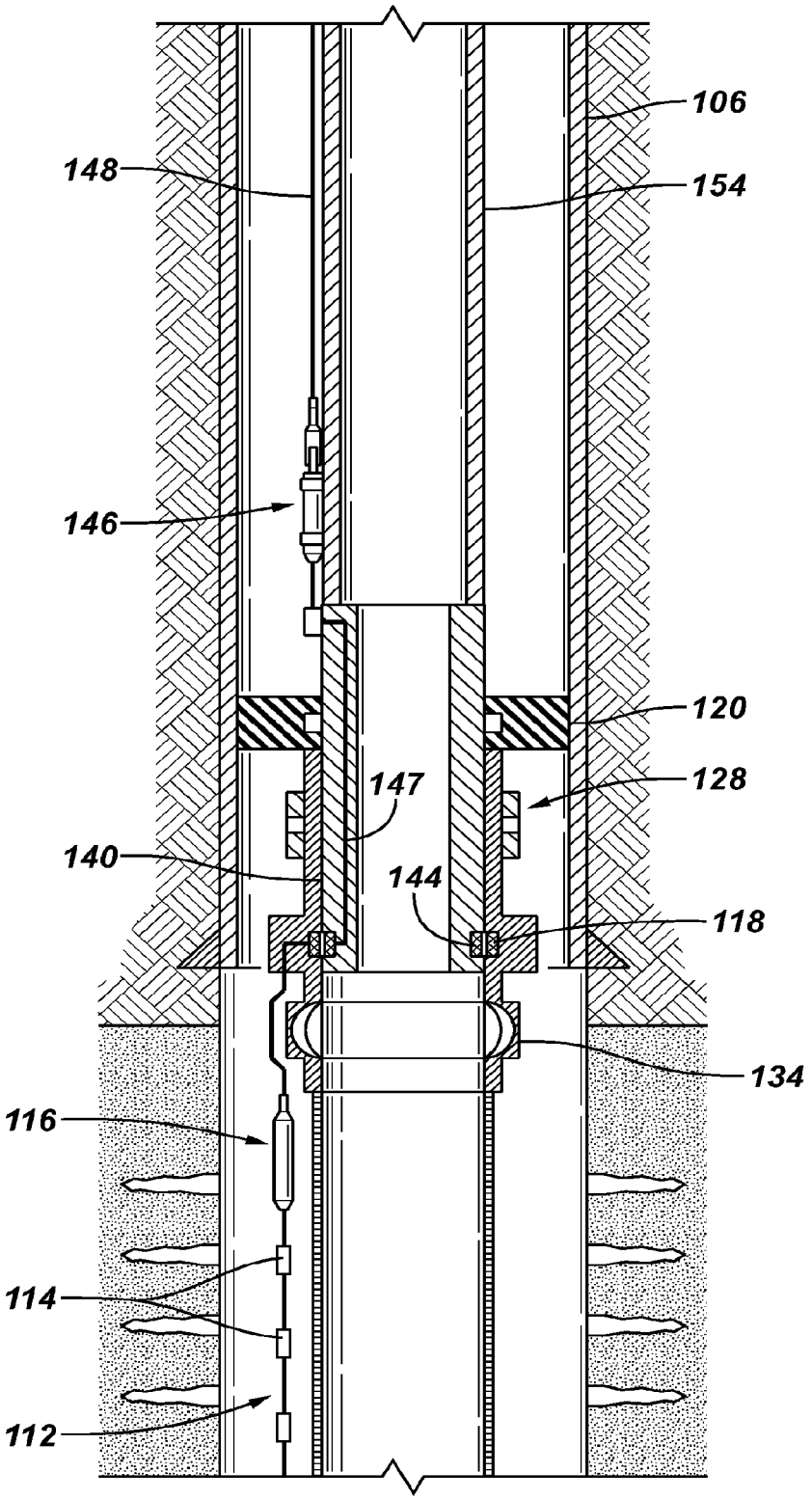
FIG. 1B provides a slightly different view of the completion system of FIG. 1A.

FIG. 1B shows a slightly different view of the two-stage completion system depicted in FIG. 1A. In FIG. 1B, the sensor cable 112, controller cartridge 116, and control station 146 are depicted with slightly different views. Functionally, the completion system of FIG. 1B is similar to the completion system of FIG. 1A.

Figure 1C:
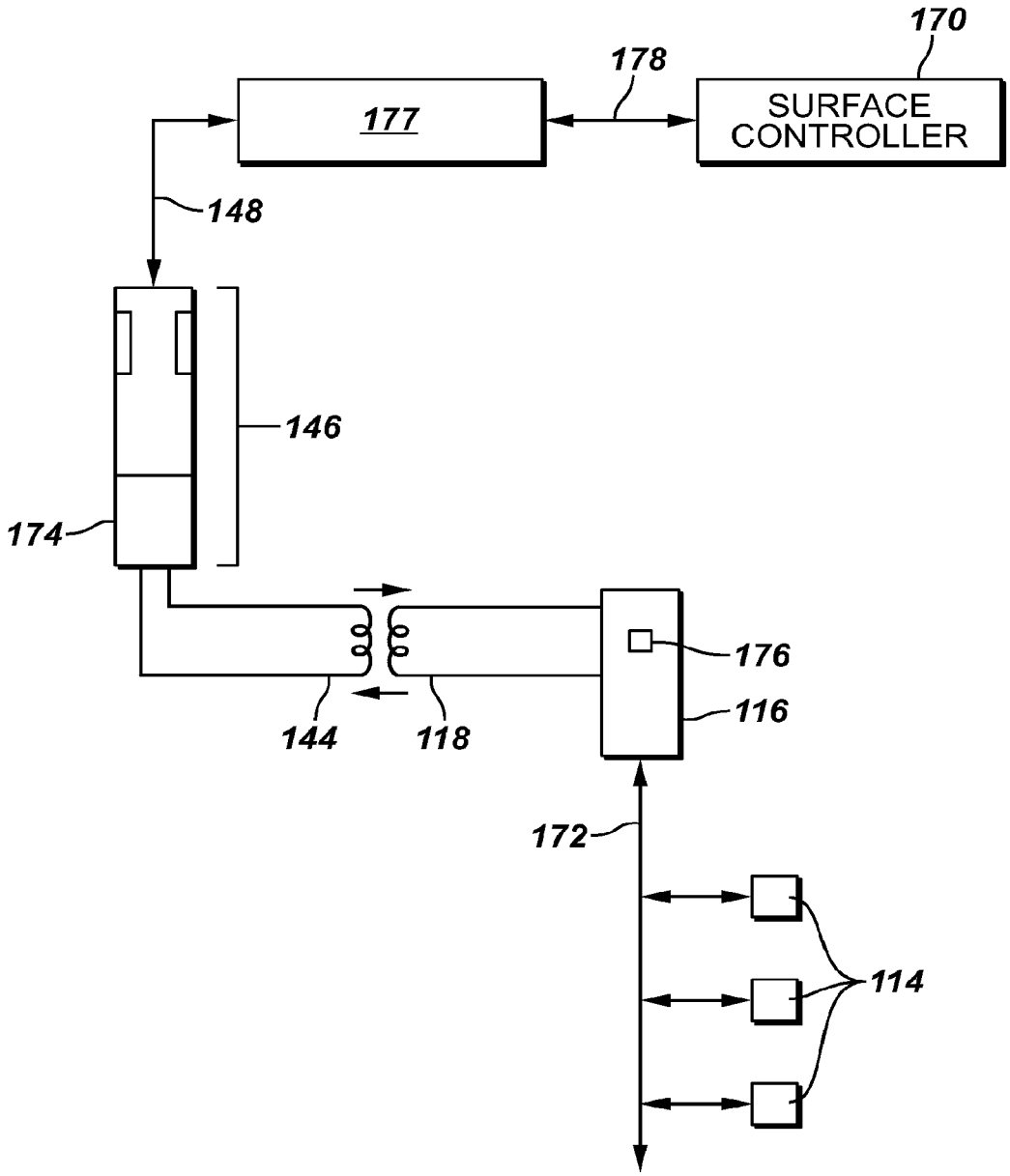
FIG. 1C is a schematic diagram of the electrical chain in the completion system of FIG. 1A.

FIG. 1C is a schematic diagram of an example electrical chain between the sensors 114 that are part of the lower completion section 102 and a surface controller 170 (provided at the earth surface). The sensors 114 communicate over a bus 172 that is part of the sensor cable 112 to the controller cartridge 116. Communication between the controller cartridge 116 and a control station interface 174 (part of control station 146) occurs through inductive coupler portions 118 and 144 (as discussed above). A switch 176 can be provided in the controller cartridge 176 to control whether or not communication is enabled through the inductive coupler portions 118 and 144. The switch 176 is controllable by the control station 146 or in response to commands sent from the surface controller 170 through the control station 146. Note that, as discussed above, the control station 146 can be omitted in some implementations, with the surface controller 170 being able to communicate with the controller cartridge 116 without the control station 146.

The control station 146 communicates power and signaling over electrical cable 148 to a communications bus interface 177. In one implementation, the communications bus interface 177 can be a ModBus interface, which is able to communicate over a ModBus communications link 178 with the surface controller 170. The ModBus communications link 178 can be a serial link implemented with RS-422, RS-485, and/or RS-232, or alternatively, the ModBus communications link 178 can be a TCP/IP (Transmission Control Protocol/Internet Protocol). The ModBus protocol is a standard communications protocol in the oilfield industry and specifications are broadly available, for example at www-.modbus.org. In alternative implementations, other types of communications links can be employed.

In one implementation, the sensors 114 can be implemented as slave devices that are responsive to requests from the control station 146. Alternatively, the sensors 114 can be able to initiate communications with the control station 146 or with the surface controller 170.

In one embodiment, communications through the inductive coupler portions 118 and 144 is accomplished using frequency modulation of data signals around a particular frequency carrier. The frequency carrier has sufficient power to supply power to the controller cartridge 116 and the sensors 114. Alternatively, the controller cartridge 176 and sensors 114 can be powered by a battery.

The sensors 114 can be scanned periodically, such as once every predefined time interval. Alternatively, the sensors 114 are accessed in response to a specific request (such as from the control station 146 or surface controller 170) to retrieve measurement data.

Figure 1D:
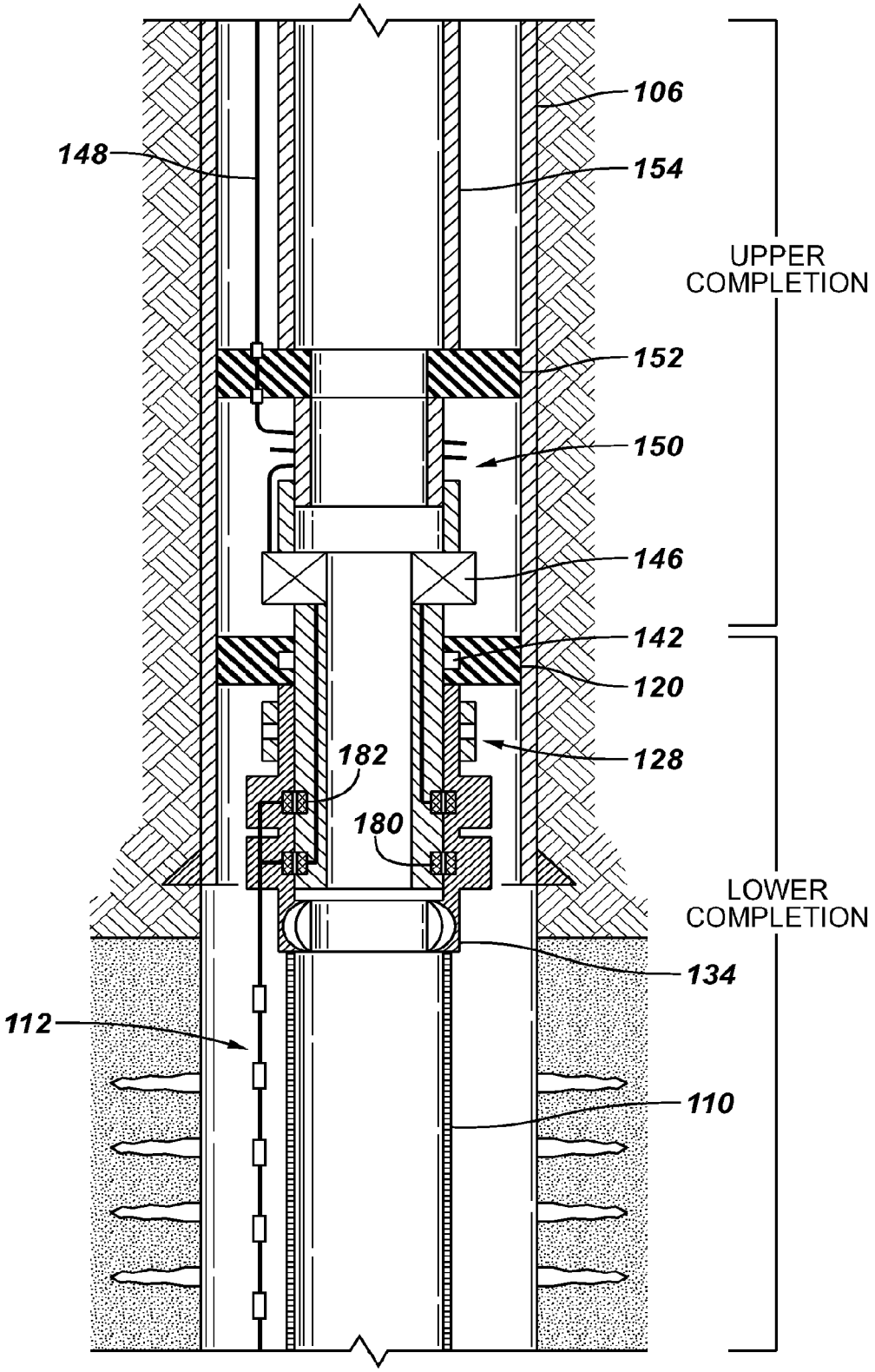
FIGS. 1D-1E illustrate other embodiments of a two-stage completions system.

FIG. 1D illustrates yet another variant of the two-stage completion system. In the FIG. 1A embodiment, a single inductive coupler is used to provide for both power and signal (data) communication. However, according to FIG. 1D, two inductive couplers are employed, an inductive coupler 180 for power and an inductive coupler 182 for data communication.

Figure 1E:
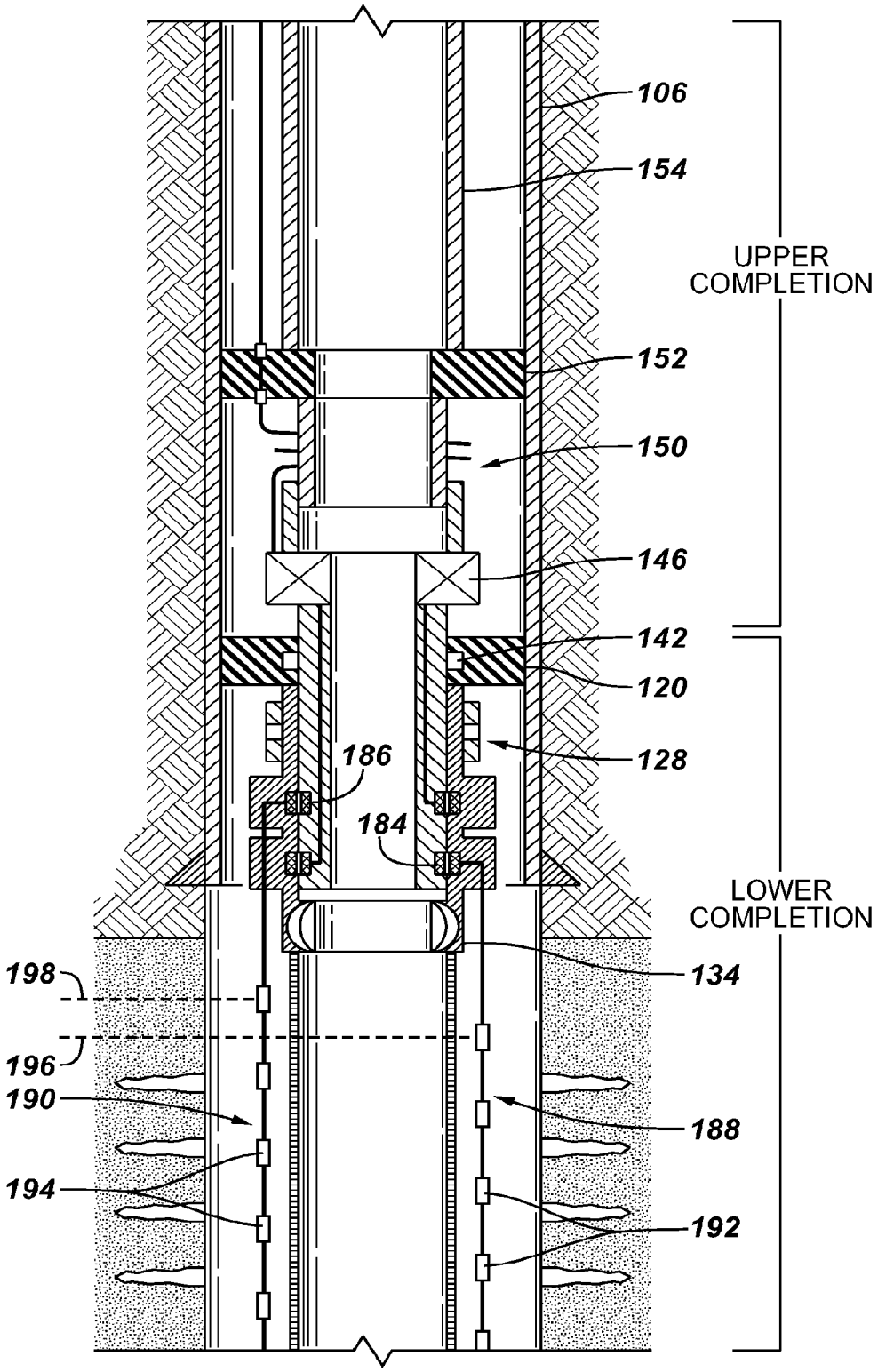

FIG. 1E shows another embodiment that uses two inductive couplers 184 and 186, where the first inductive coupler 184 is used for power and data communication with a first sensor cable 188, and the second inductive coupler 186 is used to provide power and data communication with a second sensor cable 190. The use of two inductive couplers and two corresponding sensor cables in the FIG. 1E embodiment provides for redundancy in case of failure of one of the sensor cables or one of the inductive couplers. The sensor cables 188 and 190 are generally parallel to each other. However, the sensors 192 of the sensor cable 188 are offset along the longitudinal direction of the wellbore with respect to sensors 194 of the sensor cable 190. In other words, in the longitudinal direction, each sensor 192 is positioned between two successive sensors 194 (see dashed line 196 in FIG. 1E). Similarly, each sensor 194 is positioned between two successive sensors 192 (see dashed line 198 in FIG. 1E). By providing longitudinal offsets of sensors 192 and 194, the sensors 192 and 194 are able to collect measurements at different depths in the wellbore. In this manner, the effective density of sensors in the region of interest is increased if both sensor cables 188 and 190 are operational.

In another embodiment, the sensor cables 188 and 190 can be run in series instead of in parallel as depicted in FIG. 1E. In yet another arrangement, instead of both cables 188 and 190 being sensor cables, one of the cables can be a cable used to provide control, such as to control a flow control device (or alternatively, one of the cables can be a combination sensor and control cable).

In the embodiments discussed above, a sensor cable provides electrical wires that interconnect the multiple sensors in a collection or array of sensors. In an alternative implementation, wires between sensors can be omitted. In this case, multiple inductive coupler portions can be provided for corresponding sensors, with the upper completion section providing corresponding inductive coupler portions to interact with the inductive coupler portions associated with respective sensors to communicate power and data with the sensors.

Moreover, even though reference has been made to communicating data between the sensors and another component in the well, it is noted that in alternative implementations, and in particular in implementations where sensors are provided with their own power sources downhole, the sensors can be provided with just enough micro-power that the sensors can make measurements and store data over a relatively long period of time (e.g., months). Later, an intervention tool can be lowered to communicate with the sensors to retrieve the collected measurement data. In one embodiment, the communication between the intervention tool would be accomplished using inductive coupling, wherein one inductive coupler portion is permanently installed in the completion, and the mating inductive coupler portion is on the intervention tool. The intervention tool could also replenish (e.g., charge) the downhole power sources.

Figure 4:
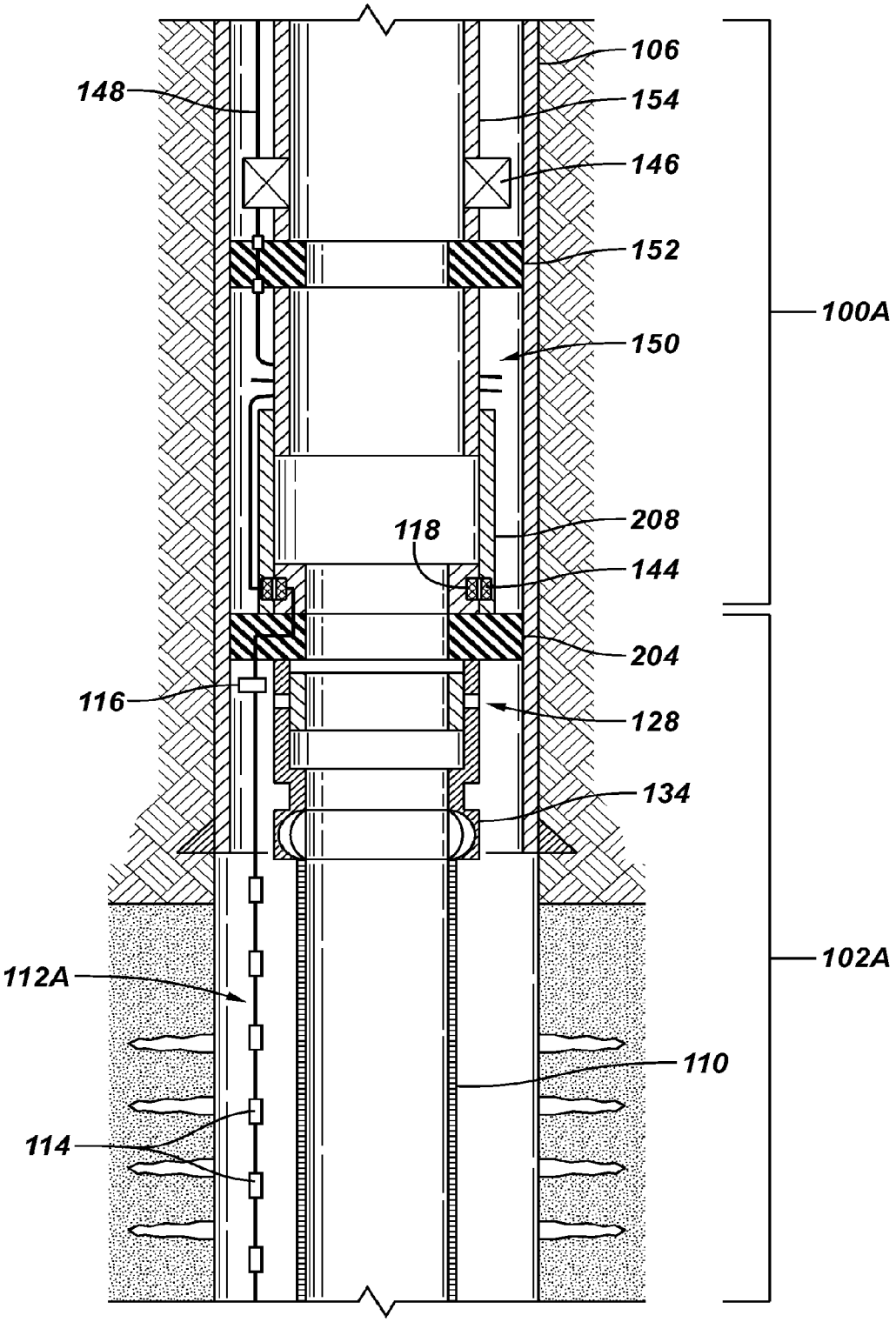
FIGS. 4-6 illustrate different embodiments of two-stage completion systems having inductively coupled wet connect mechanisms.

FIG. 4 illustrates a different embodiment of a two-stage completion system in which the positions of the inductive coupler portions and of the control station have been changed. The completion system includes an upper completion section 100A and a lower completion section 102A. In the FIG. 4 embodiment, the first inductive coupler portion 118 is provided above a packer 204 (a ported packer) of the lower completion section 102A. The first inductive coupler portion 118 can in turn be electrically connected to the controller cartridge 116 (located below the packer 204), which is connected to a sensor cable 112A. The sensor cable 112A has a portion that passes through a port of the ported packer 204 to allow communication between sensors 114 and the controller cartridge 116.

The upper completion section 100A has a lower section 208 that provides the second inductive coupler portion 144 for communicating with the first inductive coupler portion 118 when the upper completion section 100A is engaged with the lower completion section 102A.

In the embodiment of FIG. 4, the control station 146 is provided above the ported packer 152 (as compared to the position of the control station 146 below the ported packer 152 in FIGS. 1A and 3).

The remaining components depicted in FIG. 4 are the same as or similar to corresponding components in FIGS. 1A, 2, and 3 and thus are not further described.

Figure 5:
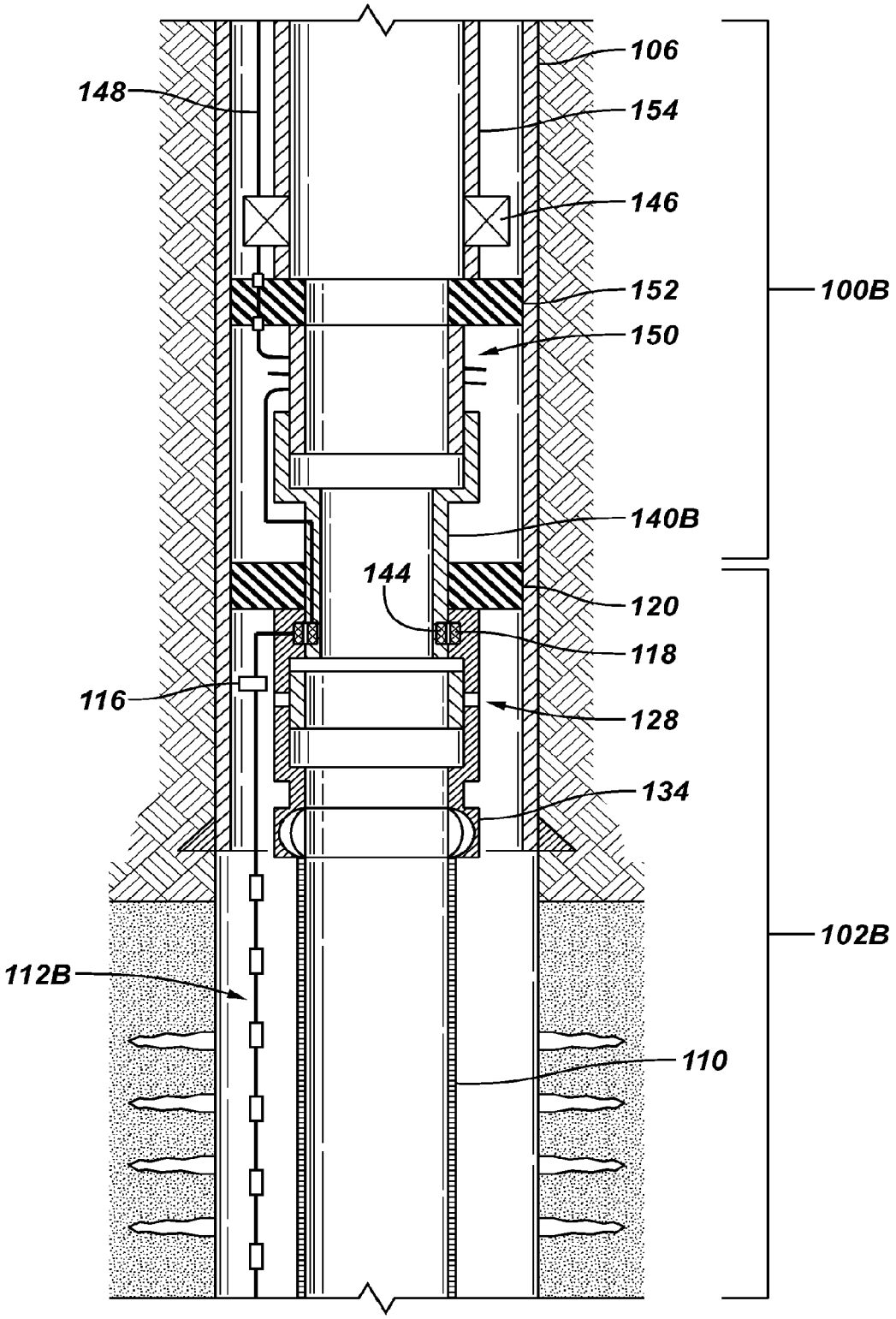

FIG. 5 shows yet another variant of the two-stage completion system that includes an upper completion section 100B and a lower completion section 102B. In this embodiment, a sensor cable 112B similar to the sensor cable 112 of FIG. 1A extends further up in the lower completion section 102B to the controller cartridge 116 that is in turn connected to the first inductive coupler portion 118. The first inductive coupler portion 118 is placed further up in the lower completion section 102B (as compared to the lower completion section 102 of FIG. 1A) such that a straddle seal assembly 140B of the upper completion section 100B does not have to extend deeply into the lower completion section 102B. As a result, when inserted into the lower completion section 102B, the straddle seal assembly 140B of the upper completion section 100B does not extend past the circulating port assembly 128, such that the circulating port 128 is not blocked when the upper completion section 100B is engaged with the lower completion section 102B. In the FIG. 5 embodiment, the inductive coupler portions 118 and 144 are positioned above the circulating port assembly 128.

In the arrangement of FIG. 5, the control station 146 is also provided above the ported packer 152 as in the FIG. 4 embodiment.

Figure 6:
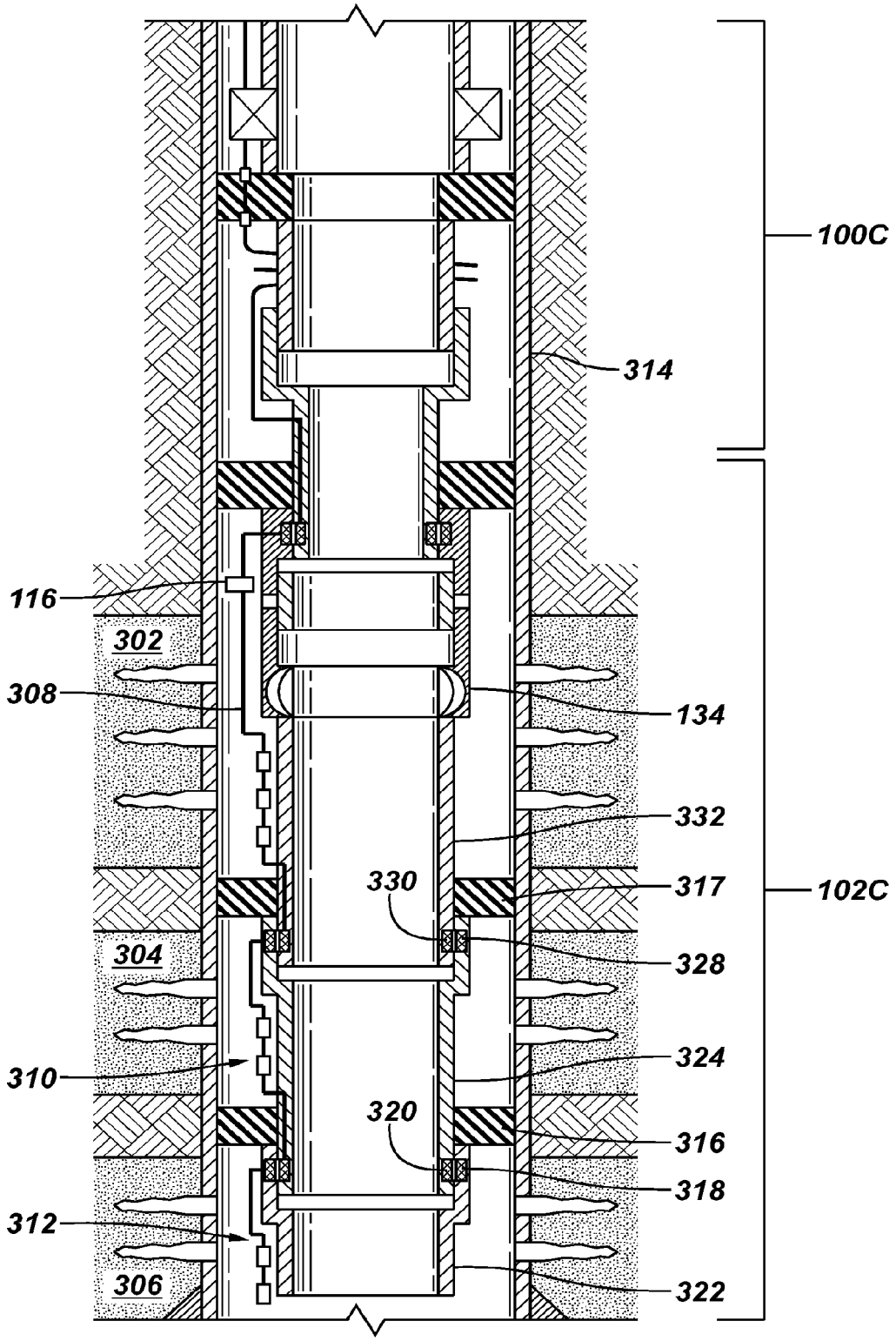

FIG. 6 shows a multi-stage completion system according to another embodiment that includes an upper completion section 100C and a lower completion section 102C that has multiple parts for multiple zones in the well. As depicted in FIG. 6, three producing zones (or injection zones) 302, 304, and 306 are depicted. The lower completion section 102C has three sets of sensor cables 308, 310, and 312 that are similar in arrangement to the sensor cable 112 of FIG. 1. Each sensor cable 308, 310, 312 has multiple sensors provided at discrete locations in respective zones 302, 304, 306. In the arrangement of FIG. 6, the zones 302, 304, and 306 are all lined with casing 314, unlike the open hole section depicted in FIG. 1. The casing 314 is perforated in each of the zones 302, 304, and 306 to enable communication between the well and reservoirs adjacent the well.

The lower completion section 102C includes a first lower packer 316 that provides isolation between zones 304 and 306, and a second lower packer 318 that provides isolation between zones 304 and 302. The lowermost sensor cable 312 is electrically connected to a first set of inductive coupler portions 318 and 320. The inductive coupler portion 318 is attached to a pipe section or screen that is attached to the first lower packer 316. On the other hand, the inductive coupler portion 320 is attached to another pipe section 324 or screen that extends upwardly to attach to another pipe section 326.

In the second zone 304, a second set of inductive coupler portions 328 and 330 are provided, where the inductive coupler portion 328 is attached to pipe section 326. On the other hand, the inductive coupler portion 330 is attached to pipe section 332 that extends upwardly to the formation isolation valve 134 of the lower completion section 102C. The remaining parts of the lower completion section 102C are similar to or the same as the lower completion section 102B of FIG. 5. The upper completion section 100C that is engaged with the lower completion section 102C is also similar to or the same as the upper completion section 100B of FIG. 5.

In operation, the lower completion section 102C is installed in different trips, with the lowermost part of the lower completion section 102C (that corresponds to the lowermost zone 306) installed first, followed by the second part of the lower completion zone 102C that is adjacent the second zone 304, followed by the part of the lower completion section 102C adjacent the zone 302.

Power and data communication between the controller cartridge 116 and the sensors of the sensor cables 310 and 312 is performed through the inductive couplers corresponding to portions 328, 330, and 318, 320.

Figure 7:
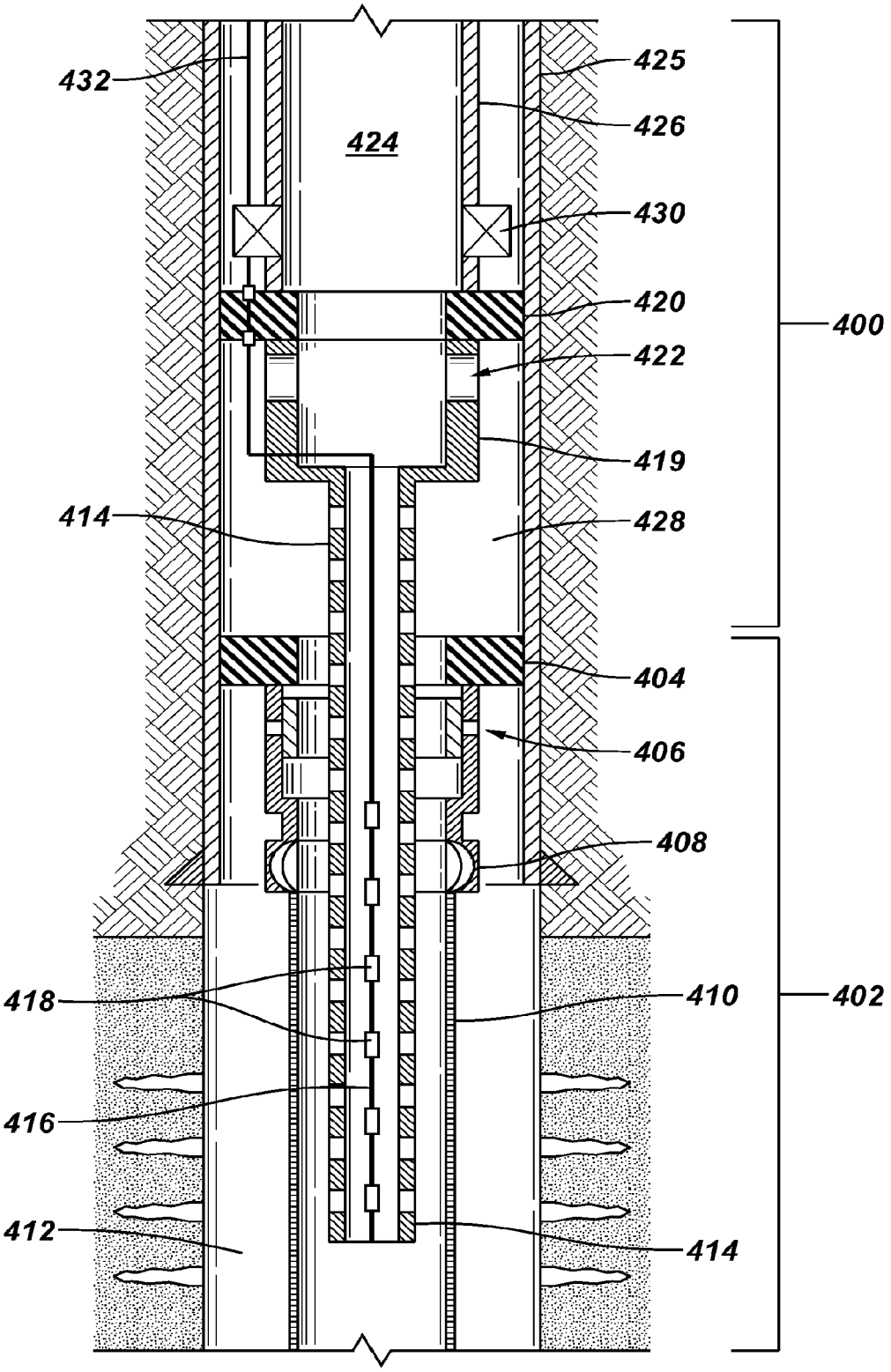
FIGS. 7, 8A, and 12 illustrate different embodiments of two-stage completion systems that do not use inductive couplers but which use stingers to deploy sensors.

FIG. 7 shows a two-stage completion system according to yet another embodiment that includes a lower completion section 402 and an upper completion section 400. A casing 425 lines a portion of the well. In the FIG. 7 embodiment, an inductively coupled wet connect mechanism is not employed, unlike the embodiments of FIGS. 1A-6. In FIG. 7, the lower completion section 402 includes a gravel pack packer 404 that is attached to a circulating port assembly 406. The lower completion section 402 also includes a formation isolation valve 408 below the circulating port assembly 406. A sand screen 410 is attached below the formation isolation valve 408 for sand control or control of other particulates. The lower completion section 402 is positioned proximate to an open hole zone 412 in which production (or injection) is performed.

Note that in the FIG. 7 embodiment, the lower completion section 402 does not include an inductive coupler portion. In the FIG. 7 embodiment, the upper completion section 400 has a stinger 414 that is made up of a slotted pipe having multiple slots to allow communication between the inner bore of the stinger 414 and the outside of the stinger 414. The stinger 414 extends into the lower completion section 402 in the proximity of the open hole zone 412.

Within the stinger 414 is arranged a sensor cable 416 having multiple sensors 418 at discrete locations across the zone 412. The sensor cable 416 extends upwardly in the stinger 414 until it exits the upper end of the stinger 414. The sensor cable 416 extends radially through a slotted pup joint 419 to a ported packer 420 of the upper completion section 400. The slotted pup joint 419 has slots 422 to allow communication between the inner bore 424 of a tubing 426 and the region 428 that is outside the upper completion section 400 and underneath the packer 420.

In the upper completion section 400, a control station 430 is provided above the packer 420. The sensor cable 416 extends through the ported packer 420 to the control station 430. The control station 430 in turn communicates over an electric cable 432 to an earth surface location or some other location in the well.

Unlike the embodiments depicted in FIG. 1A-6, the sensors 418 of the FIG. 7 embodiment are arranged inside the sand control assembly (rather than outside the sand control assembly). However, use of the stinger 414 allows for convenient placement of the sensors 418 across the sand face adjacent the sand screen 410.

In operation, the lower completion section 402 of FIG. 7 is first installed in the well adjacent the zone 412. Following gravel packing, the upper completion section 400 is run into the well, with the stinger 414 inserted into the lower completion section 402 such that the sensors 418 of the sensor cable 416 are positioned proximate to the zone 412 at various discrete locations. In some embodiment the lower completion section may not require gravel packing; instead, the lower completion section may include an expandable screen, cased and perforated hole, slotted liner, or open hole.

Figure 8A:
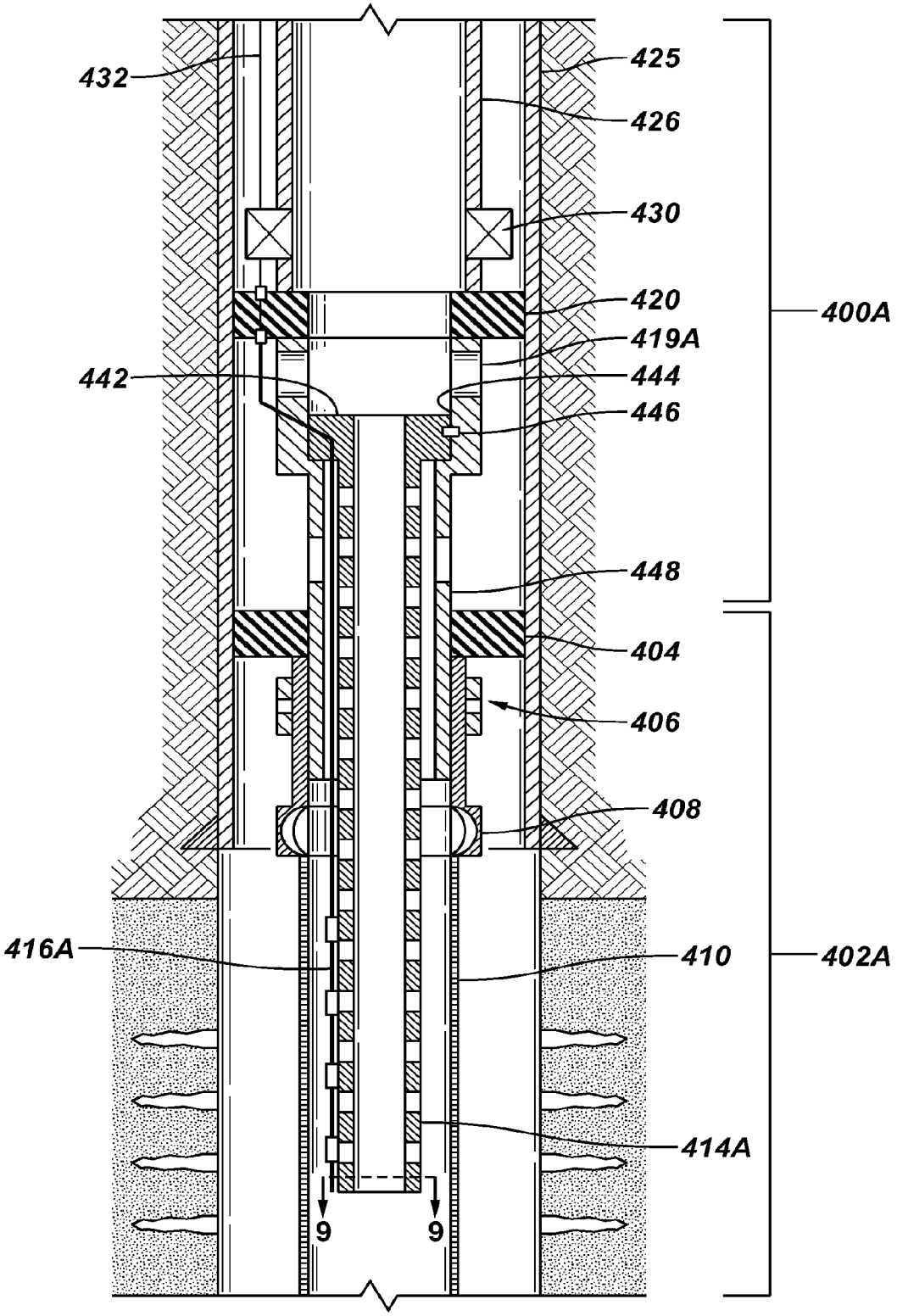
Figure 9:
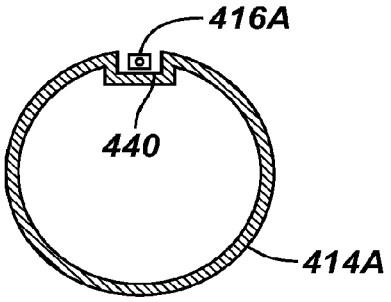
FIG. 9 is a cross-sectional view of a portion of a stinger and sensor cable in the completion system of FIG. 8A, according to an embodiment.

FIG. 8A shows yet another arrangement of a two-stage completion system having an upper completion section 400A and lower completion section 402A in which an inductively coupled wet connect mechanism is not used. A retrievable stinger 414A that is part of the upper completion section 400A is inserted into the lower completion section 402A. The lower completion section 402A is similar to or identical to the lower completion section 402 of FIG. 7. However, the stinger 414A in FIG. 8A has a longitudinal groove on its outer surface in which a sensor cable 416A is positioned. A cross-sectional view of a portion of the stinger 414A with the sensor cable 416A is depicted in FIG. 9. As shown in FIG. 9, a longitudinal groove (or dimple) 440 is provided in the outer surface of the stinger 414A such that the sensor cable 416A can be positioned in the groove 440.

Referring again to FIG. 8A, the sensor cable 416A extends upwardly until it reaches a stinger hanger 442 that rests in a stinger receptacle 444 of a slotted pup joint 419A. The sensor cable 416A extends radially through the stinger hanger 442 and the slotted pup joint 419A into a region outside the outer surface of the upper completion section 400A. The sensor cable 416A extends through the ported packer 420 to the control station 430.

Basically, the difference between the FIG. 8A embodiment and the FIG. 7 embodiment is that the sensor cable 416A is arranged outside the stinger 414A (rather than inside the stinger). Also, the stinger 414A is retrievable since it rests inside the stinger receptacle 444 on a stinger hanger 442. (FIG. 7 shows a fixed stinger that is part of the upper completion section 400). An intervention tool can be run into the well to engage the stinger hanger 442 of FIG. 8A to retrieve the stinger hanger 442 with the stinger 414A from the well. As depicted in FIG. 8A, a latching mechanism 446 is provided to engage the stinger hanger 442 to the stinger receptacle 444. In one example implementation, the latching mechanism 446 can be a snap latch mechanism.

Another difference between the upper completion section 400A of FIG. 8A and the upper completion section 400 of FIG. 7 is that the upper completion section 400A has a slotted pipe section 448 extending below the stinger receptacle 444. The slotted pipe section 448 extends into the lower completion section 402A, as depicted in FIG. 8A.

Figure 8B:
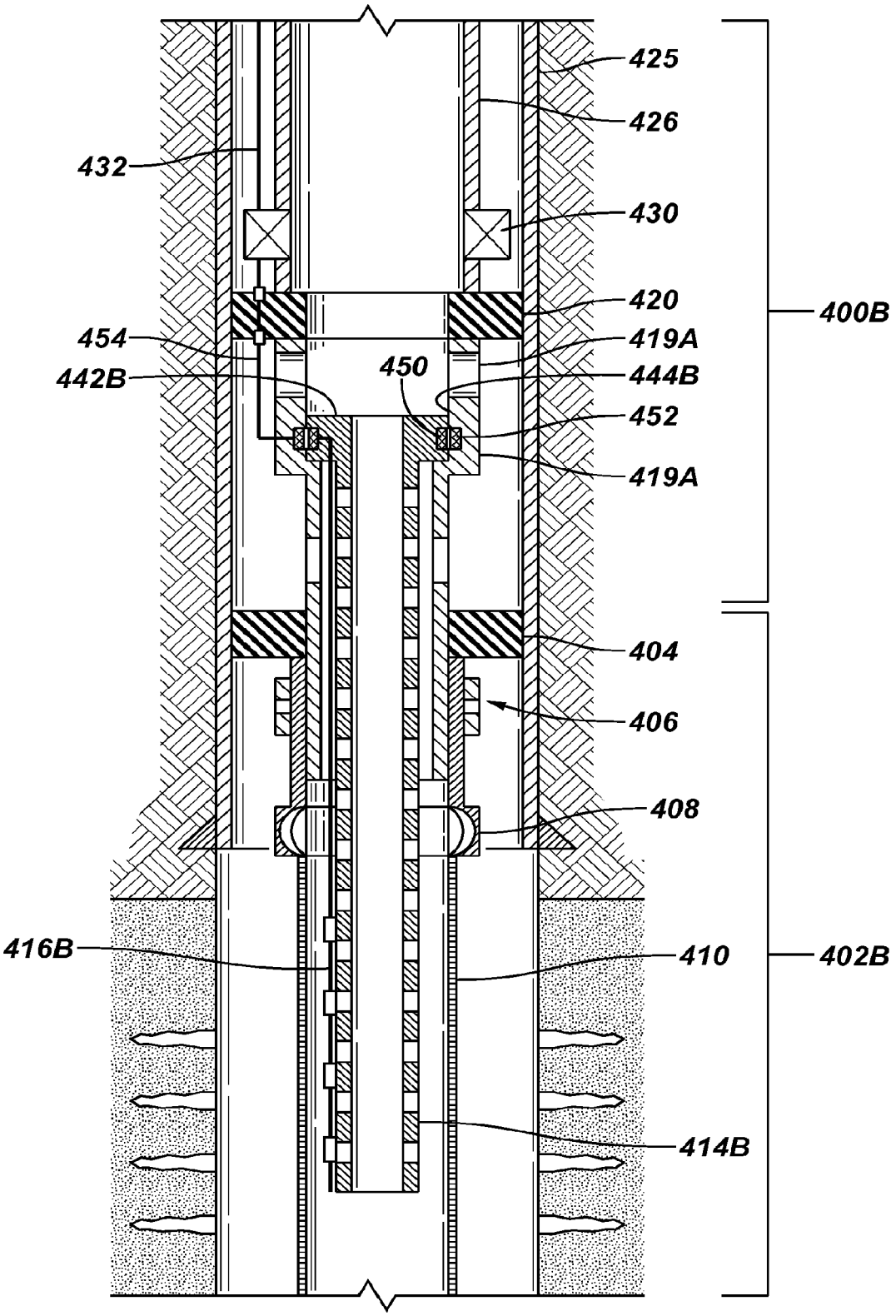
FIG. 8B illustrates a variant of the FIG. 8A embodiment that includes an inductive coupler.

FIG. 8B illustrates another variant of the two-stage completion system that also employs a retrievable stinger 414B. The stinger 414B extends from a stinger hanger 442B that rests in a stinger receptacle 444B. The difference between the FIG. 8B embodiment and the FIG. 8A embodiment is that the stinger hanger 442B has a first inductive coupler portion 450 (male inductive coupler portion) that is able to be inductively coupled to the second inductive coupler portion 452 (female inductive coupler portion) inside the stinger receptacle 444B. A sensor cable 416B (which also runs outside the stinger 414B but in a longitudinal groove) extends upwardly and is connected to the first inductive coupler portion 450 in the stinger hanger 442B. When the stinger hanger 442B is installed inside the stinger receptacle 444B, the first and second inductive coupler portions 450 and 452 are positioned adjacent each other so that electrical signaling and power can be inductively coupled between the inductive coupler portions 450 and 452.

The second inductive coupler portion 452 is connected to an electric cable 454, which passes through the ported packer 420 to the control station 430 above the packer 420.

In operation, the lower completion section 402B is first run into the well, followed by the upper completion section 400B in a separate trip. Then, the stinger 414B is run into the well, and installed in the stinger receptacle 444B of the upper completion section 400B.

Figure 10:
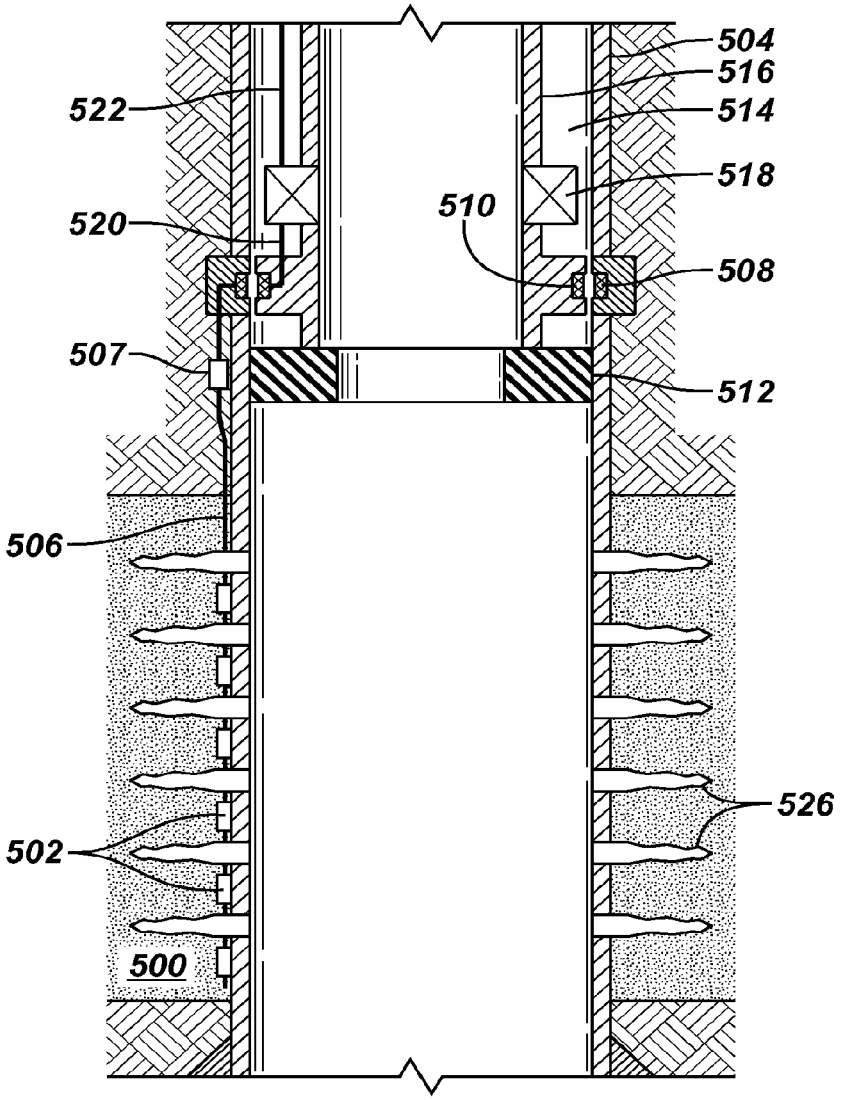
FIGS. 10 and 11 depict a completion system in which sensors and an inductive coupler portion are arranged outside a casing, according to other embodiments.

FIG. 10 illustrates yet another embodiment of another completion system that provides sensors in a producing (or injection) zone. In the embodiment of FIG. 10, sensors 502 are provided outside a casing 504 that lines the well. The sensors 502 are also part of a sensor cable 506. The sensors 502 are provided at various discrete locations outside the casing 504. The sensor cable 506 runs upwardly to a first inductive coupler portion 508 (female inductive coupler portion) through a controller cartridge 507. The first inductive coupler portion 508 interacts with a second inductive coupler portion 510 (male inductive coupler portion) to communicate power and data. The first inductive coupler portion 508 is located outside the casing 504, whereas the second inductive coupler portion 510 is located inside the casing 504.

Inside the casing 504, a packer 512 is set to isolate an annulus region 514 that is above the packer 512 and between a tubing 516 and the casing 504. The second inductive coupler portion 510 is electrically connected to a control station 518 over an electric cable section 520. In turn, the control station 518 is connected to another electric cable 522 that can extend to the earth surface or elsewhere in the well.

In operation, the casing 504 is installed into the well with the sensor cable 506 and first inductive coupler portion 508 provided with the casing 504 during installation. Subsequently, after the casing 504 has been installed, the completion equipment inside the casing can be installed, including those depicted in FIG. 10. Prior to or after installation of the components depicted in FIG. 10, a perforating gun (not shown) can be lowered into the well to the producing (or injection) zone 500. The perforating gun can then be activated to produce perforations 526 through the casing 504 and into the surrounding formation. Directional perforation can be performed to avoid damage to the sensor cable 506 that is located outside the casing 504.

Figure 11:
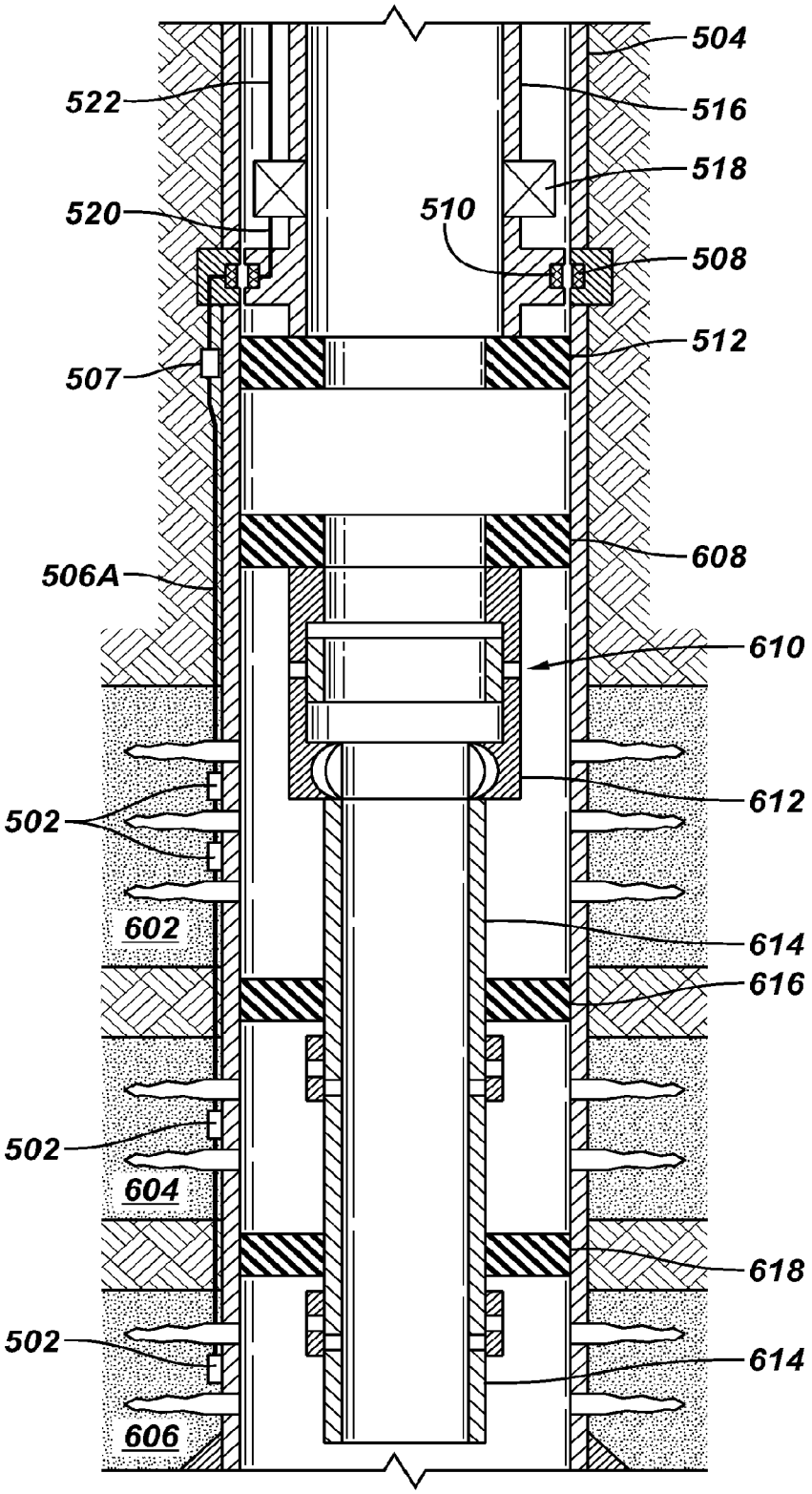

FIG. 11 illustrates yet another different arrangement of the completion system, which is similar to the completion system of FIG. 10 except that the completion system of FIG. 11 has multiple stages to correspond to multiple different zones 602, 604, and 606. In the embodiment of FIG. 11, a sensor cable 506A is also provided outside the casing 504, with the sensor cable 506A having sensors 502 provided at various locations in the different zones 602, 604, and 606. The sensor cable 506A extends to the first inductive coupler portion 508 through the controller cartridge 507.

The completion system of FIG. 11 also includes the packer 512, the second inductive coupler portion 510 inside the casing 504, control station 518, and electric cable sections 520 and 522, as in the FIG. 10 embodiment. The FIG. 11 embodiment differs from the FIG. 10 embodiment in that additional completion equipment is provided below the packer 512. In FIG. 11, a gravel pack packer 608 is provided, with a circulating port assembly 610 provided below the gravel pack packer 608. A formation isolation valve 612 is also provided below the circulating port assembly 610.

Further equipment below the formation isolation valve 612 include sand screens 614 and isolation packers 616 and 618 to isolate the zones 602, 604, and 606.

Figure 12:
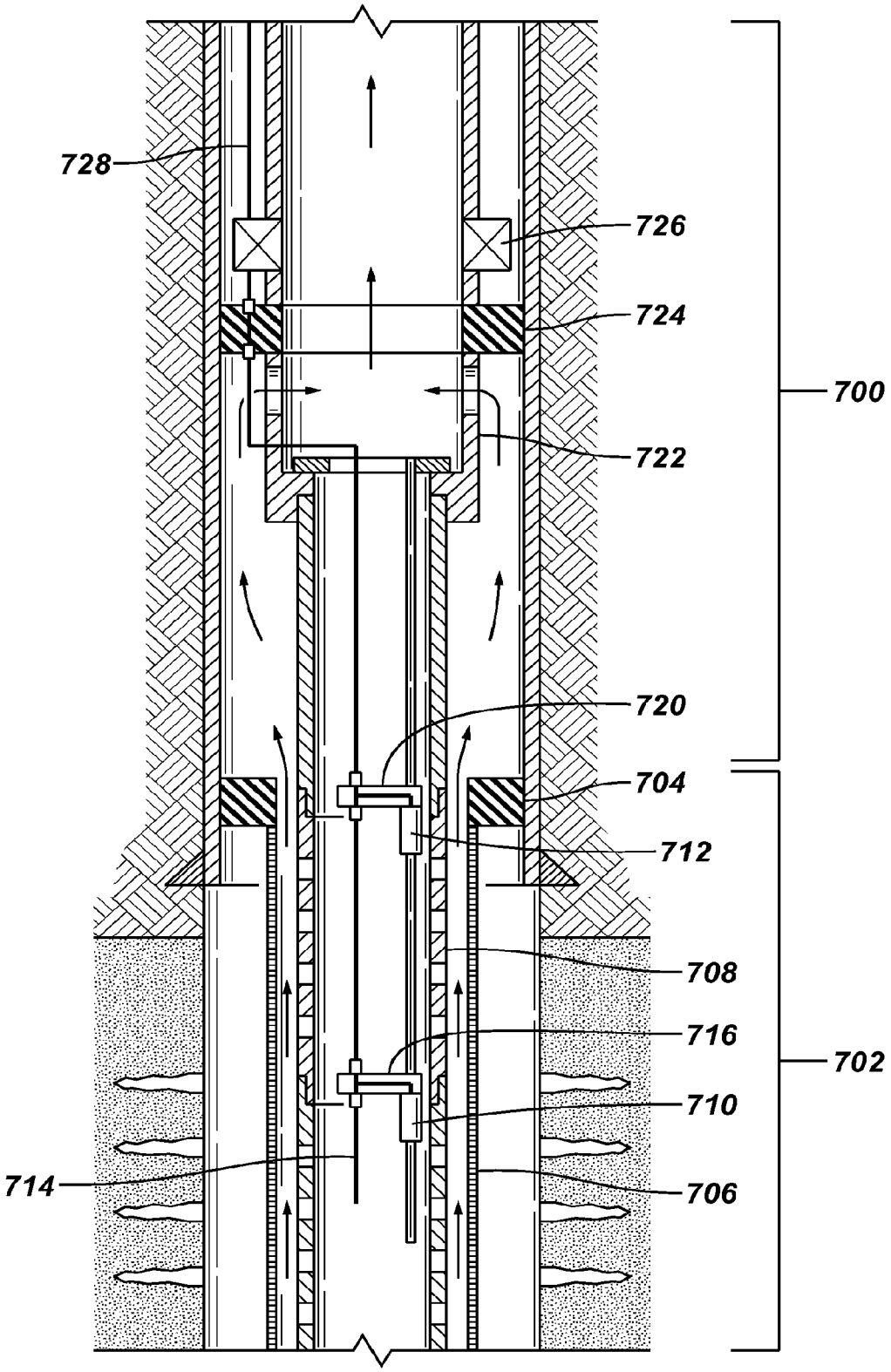

FIG. 12 illustrates another embodiment of a completion system that uses a stinger design and that does not use an inductively coupled wet connect mechanism. The completion system includes an upper completion section 700 and a lower completion section 702. In FIG. 12, a gravel pack packer 704 is set in a producing (or injection) zone, with a sand screen 706 attached below the packer 704. The gravel pack packer 704 and screen 706 are part of the lower completion section 702.

The upper completion section 700 includes a stinger 708 (which includes a perforated pipe). Within the inner bore of the stinger 708 are arranged various sensors 710 and 712. The sensors 710 and 712 are connected by Y-connections to an electric cable 714. The electric cable 714 runs through Y-connect bulkheads 716 and 720 and exits the upper end of the stinger 708. The electric cable 714 extends radially through a ported sub 722 and then passes through a ported packer 724 of the upper completion section 700 to a control station 726. The control station 726 in turn is connected by an electric cable 728 to the earth surface or to another location in the well.

Figure 13:
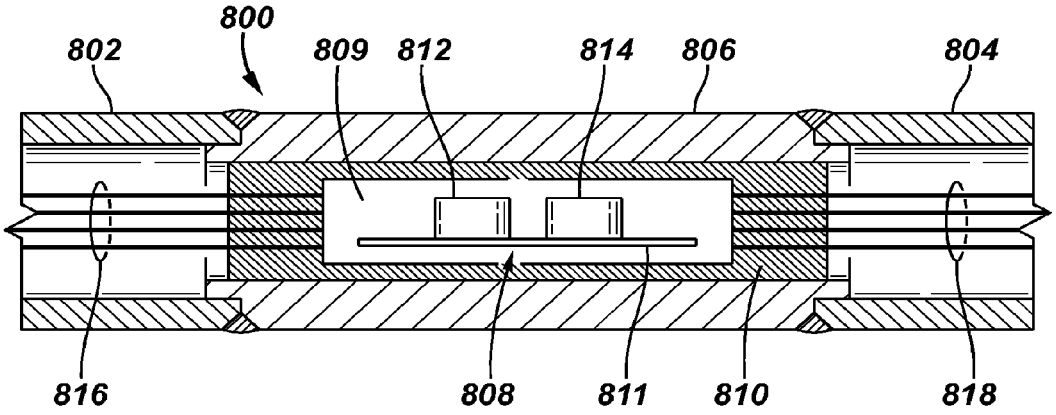
FIGS. 13 and 14 illustrate different embodiments of portions of sensor cables usable in the various completion systems.

FIG. 13 shows a portion of a sensor cable 800 according to an embodiment, which can be any one of the sensor cables mentioned above. The sensor cable 800 includes outer housing sections 802 and 804, which are sealably connected to a sensor housing structure 806 that houses a sensor support 810 and a sensor 808. The sensor 808 is positioned in a chamber 809 of the sensor support 810. The sensor support housing 806 and the housing sections 802 and 804 of the sensor cable 800 can be formed of metal. The housing sections 802, 804 can be welded to sensor support housing 806 to provide a sealing engagement (to keep wellbore fluids from entering the sensor cable 800). The sensor support 810 can also be formed of a metal to act as a chassis. As an example, the metal used to form the sensor support 810 can be aluminum. Similarly, the metal used to form the housing sections 802, 804 and sensor support housing 806 can also be aluminum. If the sensor 808 is a temperature sensor, then aluminum is a relatively good thermal coupler to allow for accurate temperature measurement. However, in other implementations, other types of metal can be used. Also, non-metallic materials can also be used to implement elements 802, 804, 806, and 810.

As further depicted in FIG. 13, the sensor 808 includes a sensor chip 812 (e.g., a sensor chip to measure temperature) and a communications interface 814 (electrically connected to the sensor chip 812) to enable communication with electrical wires 816 and 818 that extend in the sensor cable 800. In one example implementation, the communications interface 814 is an I2C interface. Alternatively, other types of communications interfaces can be used with the sensor 808. The sensor chip 812 and interface 814 can be mounted on a circuit board 811 in one implementation.

The portion depicted in FIG. 13 is repeated along the length of the sensor cable 800 to provide multiple sensors 808 along the sensor cable 800 at various discrete locations. In accordance with some embodiments, the sensor cable 800 is implemented with bi-directional twisted pair wires, which have relatively high immunity to noise. Signals on twisted pair wires are represented by voltage differences between two wires. The successive housing sections 802, 804 and sensor housing structures 806 are collectively referred to as the "outer liner" of the sensor cable 800.

A benefit of using welding in the sensor cable is that O-ring or discrete metal seals can be avoided. However, in other implementations, O-ring or metal seals can be used. In an alternative implementation, instead of using welding to weld the housing sections 802, 804 with the sensor support housing 806, other forms of sealing engagement or attachment can be provided between the housing sections 802, 804, and sensor support housing 806.

Figure 14:
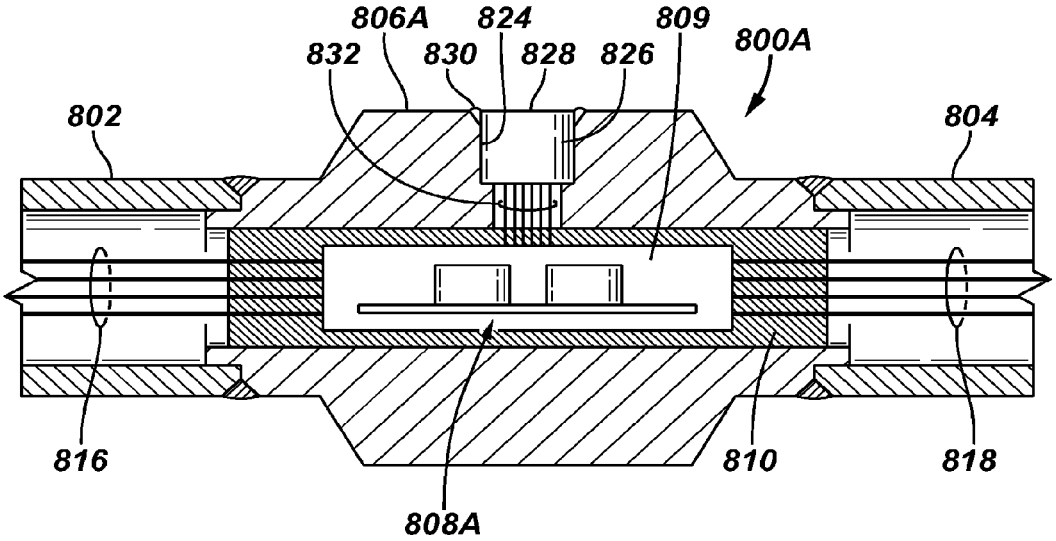

FIG. 14 illustrates a sensor cable 800A according to a different embodiment. In this embodiment, housing sections 802, 804 of the sensor cable 800A are sealably connected to a sensor support housing 806A that has an outer diameter wider than the outer diameter of the housing sections 802, 804. In other words, the sensor support housing 806A protrudes radially outwardly with respect to the housing sections 802, 804. As with the sensor cable 800 of FIG. 13, the housing sections 802, 804 can be welded to the sensor support housing 806A to provide sealing engagement. Alternatively, other forms of sealing engagement or attachment can be employed. The enlarged diameter or width of the sensor support housing 806A allows for a cavity 824 to be defined in the sensor support housing 806A. The cavity 824 can be used to receive a pressure and temperature sensor element 826, which can be used to detect both pressure and temperature (or just one of pressure and temperature) or any other type of sensors. An outer surface 828 of the sensor element 826 is exposed to the external environment outside the sensor cable 800A. The sensor element 826 is sealably attached to the sensor support housing 806A by connections 830, which can be welded connections or other types of sealing connections.

Wires 832 connect the sensor element 826 to sensor 808A contained in the sensor support 810 inside the sensor support housing 806A. The wires 832 connect the sensor element 826 to the sensor chip 812 of the sensor 808A, which sensor chip 812 is able to detect pressure and temperature based on signals from the sensor element 826.

Figure 15:
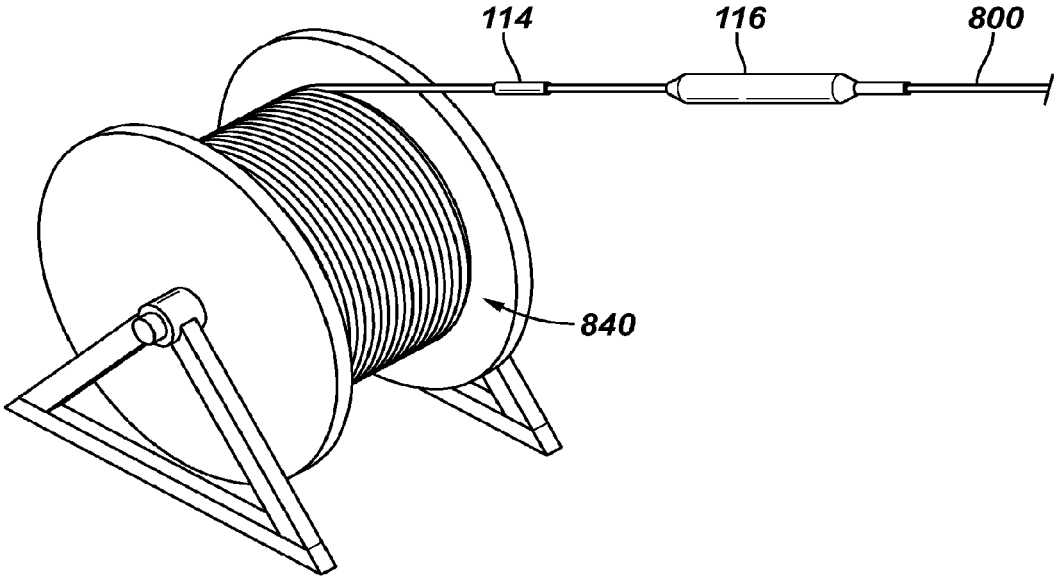
FIG. 15 illustrates a spool on which a sensor cable is wound, according to an embodiment.

FIG. 15 shows a sensor cable 800 that is deployed on a spool 840. As depicted in FIG. 15, the sensor cable 800 includes the controller cartridge 116 and a sensor 114. Additional sensors 114 that are part of the sensor cable 800 are wound onto the spool 840. To deploy the sensor cable 800, the sensor cable 800 is unwound until a desired length (and number of sensors 114) has been unwound, and the sensor cable 800 can be cut and attached to a completion system.

Figure 16:
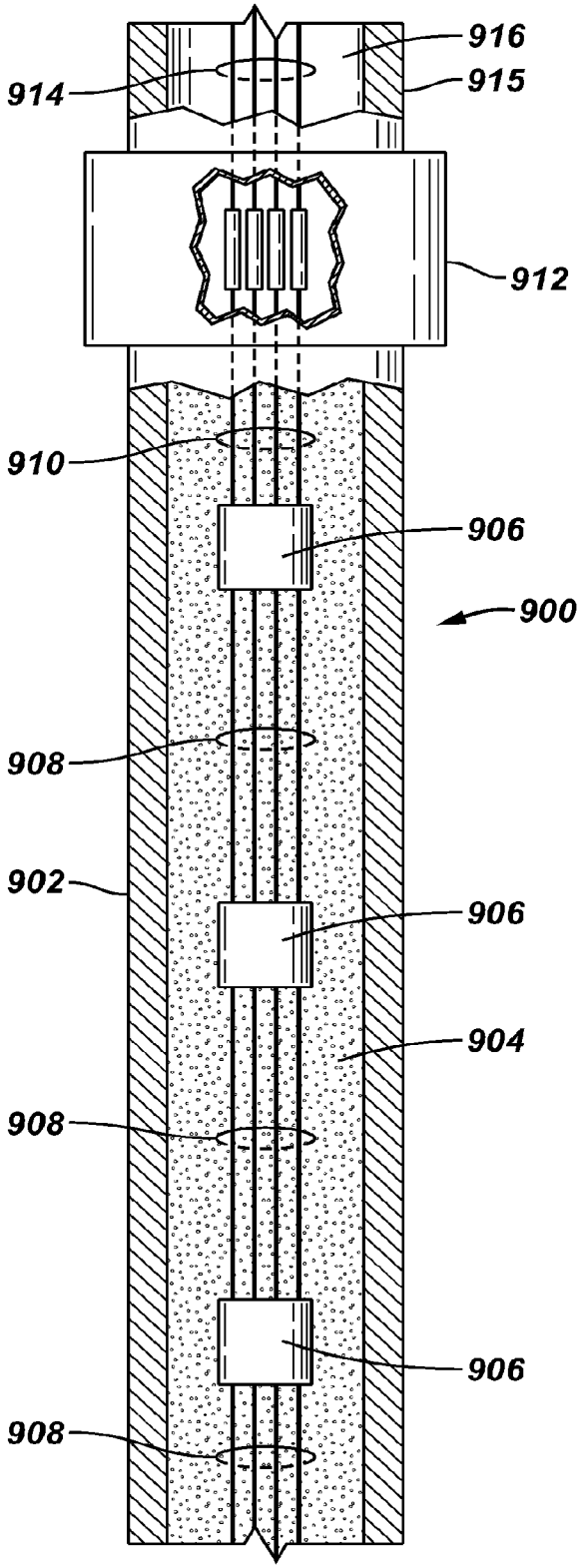
FIGS. 16-18 illustrate other types of sensor cables, according to further embodiments.

FIG. 16 shows an alternative embodiment of a sensor cable 900, which is made up of a control line 902 (which can be formed of a metal such as steel, for example). Note that the control line 902 is a continuous control line that includes multiple sensors. The control line 902 has an inner bore 904 in which sensors 906 are provided, where the sensors 906 are interconnected by electrical wires 908. In accordance with some embodiments, the inner bore 904 of the control line 902 is filled with a non-electrically conductive liquid to provide efficient heat transfer between the outside of the control line 902 and the sensors 906. The non-electrically conductive liquid (or other fluid) in the inner bore 904 is thermally conductive to provide the heat transfer. Also, the fluid in the control line 902 allows for averaging of temperature over a certain length of the control line 902, due to the thermally conductive characteristics of the fluid.

In accordance with some embodiments, the sensors 906 can be implemented with resistance temperature detectors (RTDs). RTDs are thin film devices that measure temperature based on correlation between electrical resistance of electrically-conductive materials and changing temperature. In many cases, RTDs are formed using platinum due to platinum's linear resistance-temperature relationship. However, RTDs formed of other materials can also be used. Precision RTDs are widely available within the industry, for example, from Heraeus Sensor Technology, Reinhard-Heraeus-Ring 23, D-63801 Kleinostheim, Germany.

The use of inductive coupling according to some embodiments enables a significant variety of sensing techniques, not just temperature measurements. Pressure, flow rate, fluid density, reservoir resistivity, oil/gas/water ratio, viscosity, carbon/oxygen ratio, acoustic parameters, chemical sensing (such as for scale, wax, asphaltenes, deposition, pH sensing, salinity sensing), and so forth can all receive power and/or data communication through inductive coupling. It is desirable that sensors be of small size and have relatively low power consumption. Such sensors have recently become available in the industry, such as those described in WO 02/077613. Note that the sensors may be directly measuring a property of the reservoir, or the reservoir fluid, or they may be measuring such properties through an indirect mechanism. For example, in the case that geophones or acoustic sensors are located along the sand face and where such sensors measure acoustic energy generated in the formation, that energy may come from the release of stress caused by the cracking of rock formation in a hydraulic fracturing of a nearby well. This information in turn is used to determine mechanical properties of the reservoir, such as principle stress directions, as has been described, for example, in U.S. Publication No. 2003/0205376.

The uppermost sensor 906 depicted in FIG. 16 is connected by wires 910 to a splice structure 912, which interconnects the wires 910 to wires 914 inside a control line 915 that leads to a controller cartridge (not shown in FIG. 16). Note that the splice structure 912 is provided to isolate the fluids in the control line bore 904 from a chamber 916 in the control line 915.

Figure 17:
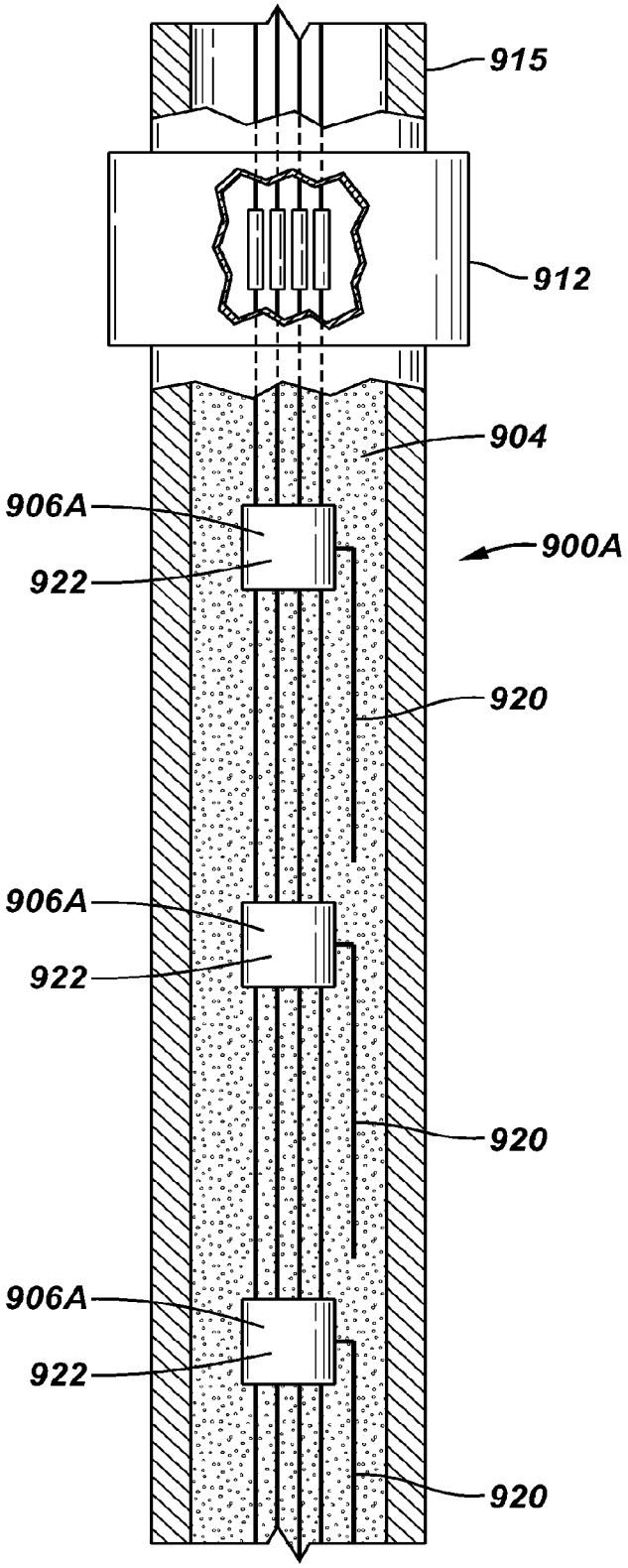

FIG. 17 illustrates a different arrangement of a sensor cable 900A. The sensor cable 900A also includes the control line 902 that defines the inner bore 904 containing a non-electrically conductive fluid. However, the difference between the sensor cable 900A of FIG. 17 and the sensor cable 900 of FIG. 16 is the use of modified sensors 906A in FIG. 17. The sensors 906A include an RTD wire filament 920 (which has a resistance that varies with temperature). The filament 920 is connected to an electronic chip 922 for detecting the resistance of the RTD wire filament 920 to enable temperature detection.

Figure 18:
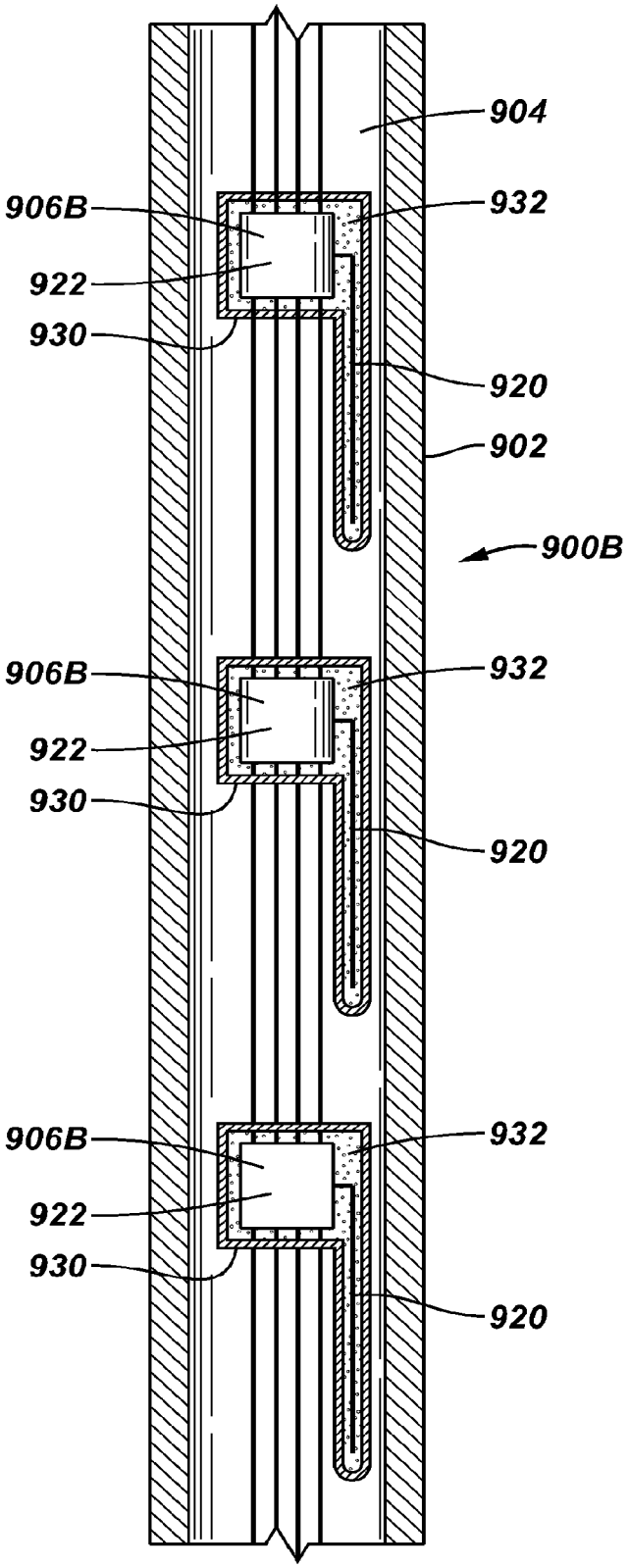

FIG. 18 illustrates yet another arrangement of a sensor cable 900B. In this embodiment, the control line 902 does not contain a liquid (rather, the inner bore 904 of the control line 902 contains air or some other gas). The sensor cable 900B includes sensors 906B have an encapsulating structure 930 to contain a non-electrically conductive liquid 932 in which the RTD filament wire 920 and electronic chip 922 are provided.

Figure 19:
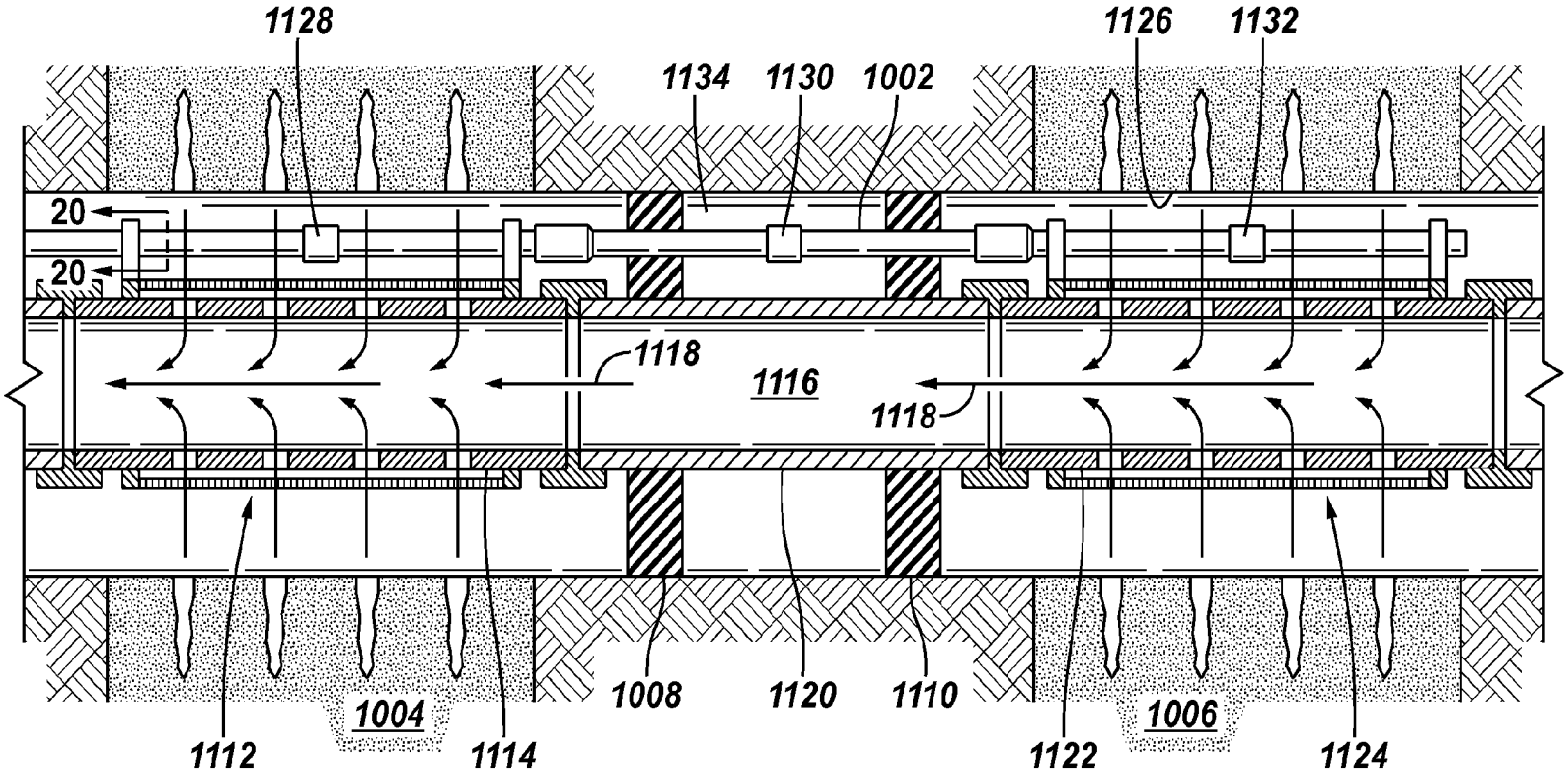
FIG. 19 is a longitudinal cross-sectional view of a completion system that includes a shunt tube to which a sensor cable is attached.

FIG. 19 shows a longitudinal cross-sectional view of another embodiment of a completion system that includes a shunt tube 1002 for carrying gravel slurry for gravel packing operations. The shunt tube 1002 extends from an earth surface location to the zones of interest. Two zones 1004 and 1006 are depicted in FIG. 19, with packers 1008 and 1010 used for zonal isolation.

In the first zone 1004, a screen assembly 1112 is provided around a perforated base pipe 1114. As depicted, fluid is allowed to flow from the reservoir in zone 1004 through the screen assembly 1112 and through perforations of the perforated pipe 1114 into an inner bore 1116 of the completion system depicted in FIG. 19. Once the fluid enters the inner bore 1116, fluid flows in the direction indicated by arrows 1118.

The perforated base pipe 1114 at its lower end is connected to a blank pipe 1120. The lower end of the blank pipe 1120 is connected to another perforated base pipe 1122 that is positioned in the second zone 1006. A screen assembly 1124 is provided around the perforated base pipe 1122 to allow fluid flow from the reservoir adjacent zone 1006 to flow fluid into the inner bore 1116 of the completion system through the screen assembly 1124 and the perforated base pipe 1122.

The perforated base pipes 1114, 1122, and the blank pipe 1120 make up a production conduit that contains the inner bore 1116. The shunt tube 1002 is provided in an annular region between the outside of this production conduit and a wall 1126 of the wellbore. In FIG. 19, the wall 1126 is a sand face. Alternatively, the wall 1126 can be a casing or liner.

As further depicted in FIG. 19, sensors 1128, 1130, and 1132 are attached to the shunt tube 1002. The sensor 1128 is provided in the zone 1004 and the sensor 1132 is provided in the zone 1006. The sensors 1128 and 1132 are placed in radial flow paths of the respective zones 1004 and 1006. On the other hand, the sensor 1130 is positioned between packers 1008 and 1110, which is in a non-flowing area of the wellbore (no fluid flow in the radial direction or longitudinal direction in the space 1134 that is defined between the two packers 1008 and 1110 and between the blank pipe 1120 and the inner wall 1126 of the wellbore).

Figure 20:
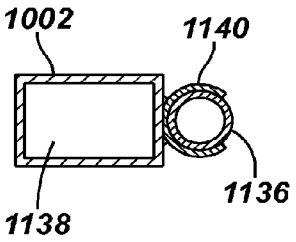
FIG. 20 is a cross-sectional view of the shunt tube and sensor cable of FIG. 19.

The sensors 1128, 1130, and 1132 are sensors on a sensor cable. A cross-sectional view of the shunt tube 1002 and a sensor cable 1136 is depicted in FIG. 20. The shunt tube 1002 has an inner bore 1138 in which gravel slurry is flowed when performing gravel packing operations. In a gravel packing operation, gravel slurry is pumped down the inner bore 1138 of the shunt tube 1002 to annular regions in the wellbore that are to be gravel packed. Attached to the shunt tube 1002 is a sensor holder clip 1140 (that is generally C-shaped in the example implementation). The sensor cable 1136 is held in place by the sensor holder clip 1140. The sensor holder clip 1140 is attached to the shunt tube 1002 by any one of various mechanisms, such as by welding or by some other type of connection. In an alternate embodiment, the shunt tubes can be omitted and a screen without shunt tube is used. The gravel is pumped in the annular cavity between the screen outer surface and wall of the well. A cable protector is attached to a screen base pipe between successive sections of the screen (or slotted or perforated pipe) for protecting the sensor and cable. In another embodiment, the sensor cable and sensors are secured to contact a base pipe such that the base pipe provides both an electrical ground for the sensor cable and sensors, and acts as a heat sink to allow dissipation of heat from the sensor cable and sensors to the base pipe.

Figure 21:
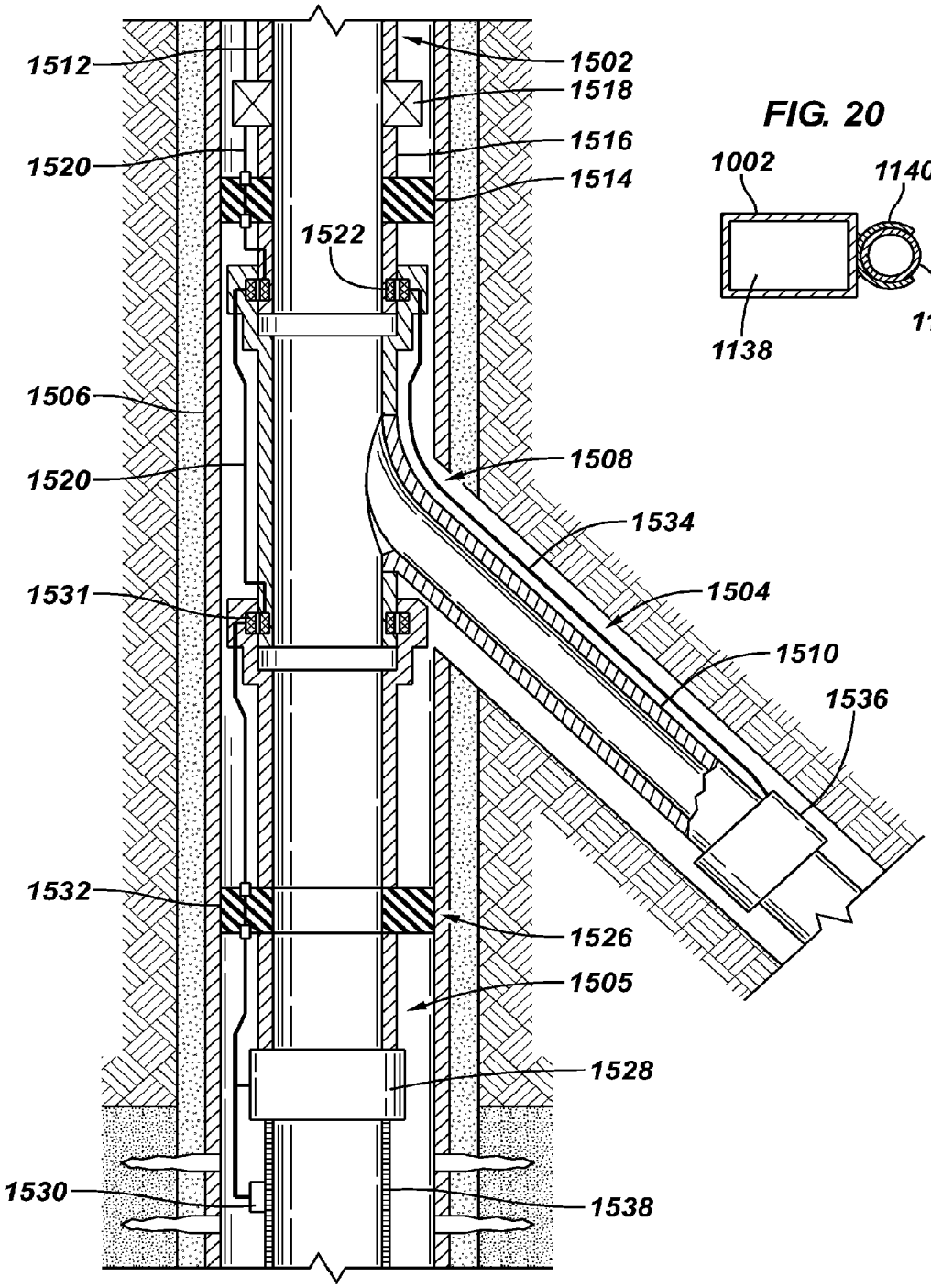
FIG. 21 illustrates a completion system for use in a multilateral well, according to another embodiment.

FIG. 21 shows an example completion system for use with a multilateral well. In the example of FIG. 21, the multilateral well includes a main wellbore section 1502, a lateral branch 1504, and a section 1505 of the main wellbore 1502 that extends below the lateral branch junction between the main wellbore 1502 and the lateral branch 1504.

As depicted in FIG. 21, the main wellbore 1502 is lined with casing 1506, with a window 1508 formed in the casing 1506 to enable a lateral completion 1510 to pass into the lateral branch 1504.

An upper completion section 1512 is provided above the lateral branch junction. The upper completion section 1512 includes a production packer 1514. Attached above the production packer 1514 is a production tubing 1516, to which a control station 1518 is attached. The control station 1518 is connected by an electric cable 1520 that passes through the production packer 1514 to an inductive coupler 1522 below the production packer 1514.

The completion in the main wellbore and the lateral is very similar to the FIG. 1A embodiment. In a variant of the FIG. 1A embodiment, flow control devices that are remotely controlled are provided. The power and communication from the main bore to lateral is accomplished though an inductive coupler 1522.

In turn, the electric cable 1520 (which is part of a lower completion section 1526) further passes through a lower packer 1532. The electric cable 1520 connects the inductive coupler 1522 to control devices (e.g., flow control valves) 1528 and sensors 1530. The lower completion section 1526 also includes a screen assembly 1538 to perform sand control. The sensors 1530 are provided proximate to the sand control assembly 1538. The lower completion may not include screen in some embodiments.

Depending on the multilateral junction construction and type an inductive coupler is run with the junction. A cable is run from junction inductive coupler to flow control valves and sensors in the junction completion similar to the FIG. 1A embodiment. The cable 1534 from inductive coupler 1522 connects to the flow control valve and sensor 1536 in the completion in the lateral section 1504.

As part of the lower completion section 1526, another inductive coupler 1531 is provided to allow communication between the electric cable 1520 and an electric cable of the main bore completion that extends into the main bore section 1505 to flow control devices and/or sensors 1528 and 1530 in the main bore section 1505.

Figure 22:
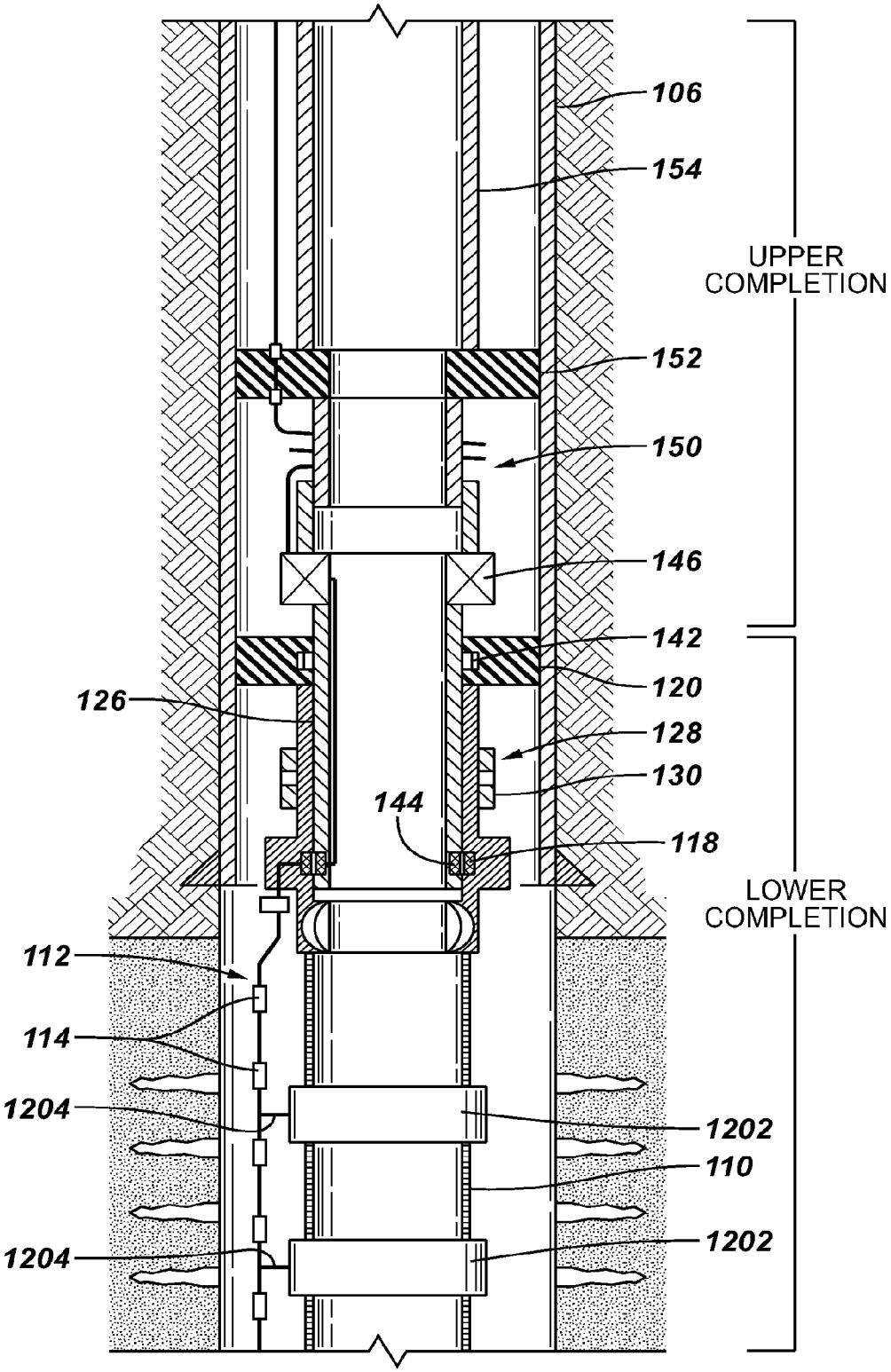
FIG. 22 illustrates a two-stage completion system that is a variant of the completion system of FIG. 1A, according to a further embodiment.

FIG. 22 shows another embodiment of a two-stage completion system that is a variant of the FIG. 1A embodiment. In the FIG. 22 embodiment, flow control devices 1202 (or other types of control devices that are remotely controllable) are provided with the sand control assembly 110. The flow control devices (or other remotely-controllable devices) are connected by respective electrical connections 1204 (such as in the form of electrical wires) to the sensor cable 112.

With this implementation, the sensor cable 112 not only is able to provide communication with sensors 114, but also is able to enable a well operator to control flow control devices (or other remotely-controllable devices) located proximate to a sand control assembly from a remote location, such as at the earth surface.

The types of flow control devices 1202 that can be used include hydraulic flow control valves (which are powered by using a hydraulic pump or atmospheric chamber that is controlled with power and signal from the earth surface through the control station 146); electric flow control valves (which are powered by power and signaling from the earth surface through the control station 146); electro-hydraulic valves (which are powered by power and signaling from the earth surface through the control station 146 and the inductive coupler); and memory-shaped alloy valves (which are powered by power and signaling from the earth surface through the control station and inductive coupler).

With electric flow control valves, a storage capacitance (in the form of a capacitor) or any other power storage device can be employed to store a charge that can be used for high actuation power requirements of the electric flow control valves. The capacitor can be trickle charged when not in use.

For electro-hydraulic valves, which employ pistons to control the amount of flow through the electro-hydraulic valves, signaling circuitry and solenoids can control the amount of fluid distribution within the pistons of the valves to allow for a large number of choke positions for fluid flow control.

A memory-shaped alloy valve relies on changing the shape of a member of the valve to cause the valve setting to change. Signaling is applied to change the shape of such element.

Figure 23:
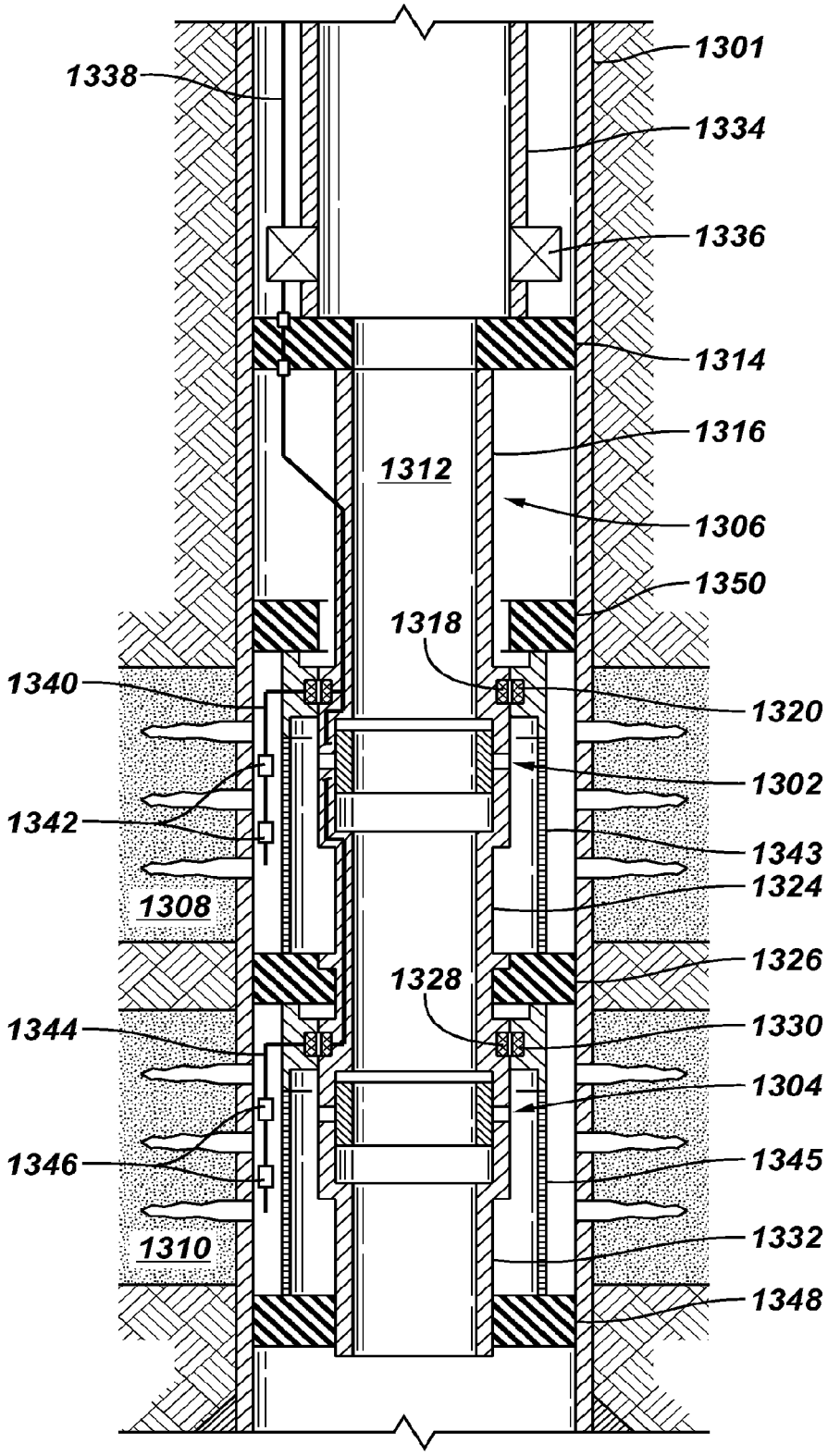
FIGS. 23-25 and 27-28 illustrate other embodiments of completion systems in which inductive couplers are used.

FIG. 23 depicts yet another arrangement of a two-stage completion system having an upper completion section 1306 and a lower completion section 1322. The upper completion section 1306 includes flow control valves 1302 and 1304, which are provided to control radial flow between respective zones 1308 (upper zone) and 1310 (lower zone) and an inner bore 1312 of the completion system. The flow control valve 1302 is an "upper" flow control value, and the flow control valve 1304 is a "lower" flow control valve. Cable 1338 from surface is electrically connected to flow control valves 1302 and 1304 through electrical conductors (not shown).

The upper completion section 1306 further includes a production packer 1314. A pipe section 1316 extends below the production packer 1314. A male inductive coupler portion 1318 is provided at a lower end of the pipe section 1316. The male inductive coupler portion 1318 interacts or axially aligns with a female inductive coupler portion 1320 that is part of the lower completion section 1322. The inductive coupler portions 1318 and 1320 together form an inductive coupler that provides an inductively coupled wet connect mechanism.

The upper completion section 1306 further includes a housing section 1324 to which the flow control valve 1302 is attached. The housing section 1324 is sealably engaged to a gravel packer 1326 that is part of the lower completion section 1322. At the lower end of the housing section 1324 is another male inductive coupler portion 1328, which interacts with another female inductive coupler portion 1330 that is part of the lower completion section 1322. Together, the inductive coupler portions 1328 and 1330 form an inductive coupler.

Below the inductive coupler portion 1328 is the lower flow control valve 1304 that is attached to a housing section 1332 of the upper completion section 1306 proximate to the lower zone 1310.

The upper completion section 1306 further includes a tubing 1334 above the production packer 1314. Also, attached to the tubing 1334 is a control station 1336 that is connected to an electric cable 1338. The electric cable 1338 extends downwardly through the production packer 1314 to electrically connect electrical conductors extending through the pipe section 1316 to the inductive coupler portion 1318, and to electric conductors extending through the housing section 1324 to the lower inductive coupler portion 1328. The flow control valves 1302 and 1304 in one embodiment can be hydraulically actuated. A hydraulic control line is run from surface to a valve for operating the valve. In yet another embodiment, the flow control valve can be electrically operated, hydroelectrically operated, or operated by other means.

In the lower completion section 1322, the upper inductive coupler portion 1320 is coupled through a controller cartridge (not shown) to an upper sensor cable 1340 having sensors 1342 for measuring characteristics associated with the upper zone 1308. Similarly, the lower inductive coupler portion 1330 is coupled through a controller cartridge (not shown) to a lower sensor cable 1344 that has sensors 1346 for measuring characteristics associated with the lower zone 1310.

At its lower end, the lower completion section 1322 has a packer 1348. The lower completion section 1322 also has a gravel pack packer 1350 at its upper end.

Figure 24:
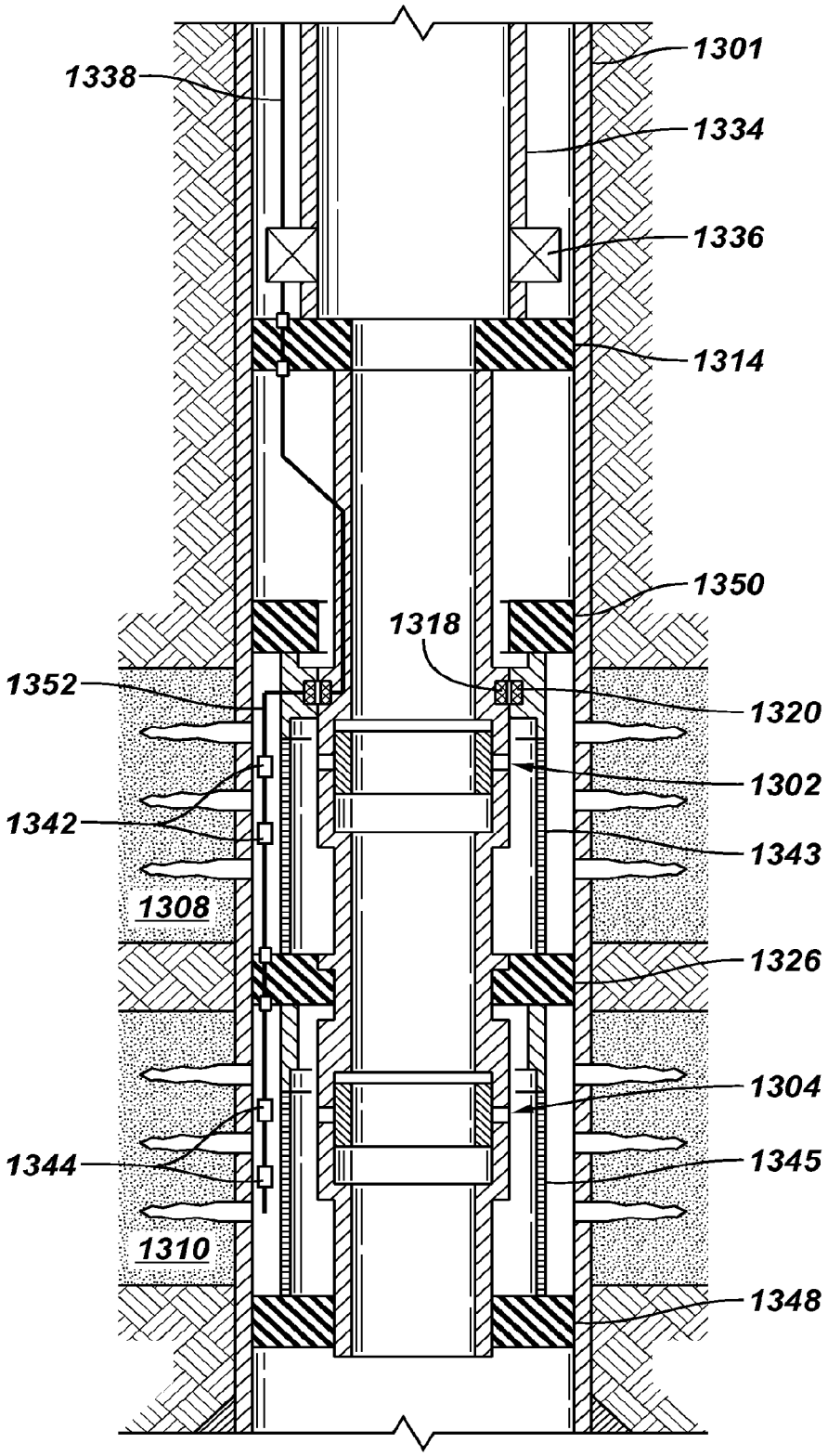

In the FIG. 23 embodiment, two inductive couplers are used for the sensor arrays 1342 and 1346, respectively. The cable 1338 is run to inductive coupler 1318 and also to flow control valve 1302 and 1304. In an alternative embodiment, as depicted in FIG. 24, a single inductive coupler is used that includes inductive coupler portions 1318 and 1320. In the FIG. 24 embodiment, a single sensor cable 1352 is provided in an annulus region between the casing 1301 and sand control assemblies 1343, 1345. The sensor cable 1352 extends through the isolation packer 1326 to provide sensors 1342 in upper zone 1308, and sensors 1346 in lower zone 1310.

Figure 25:
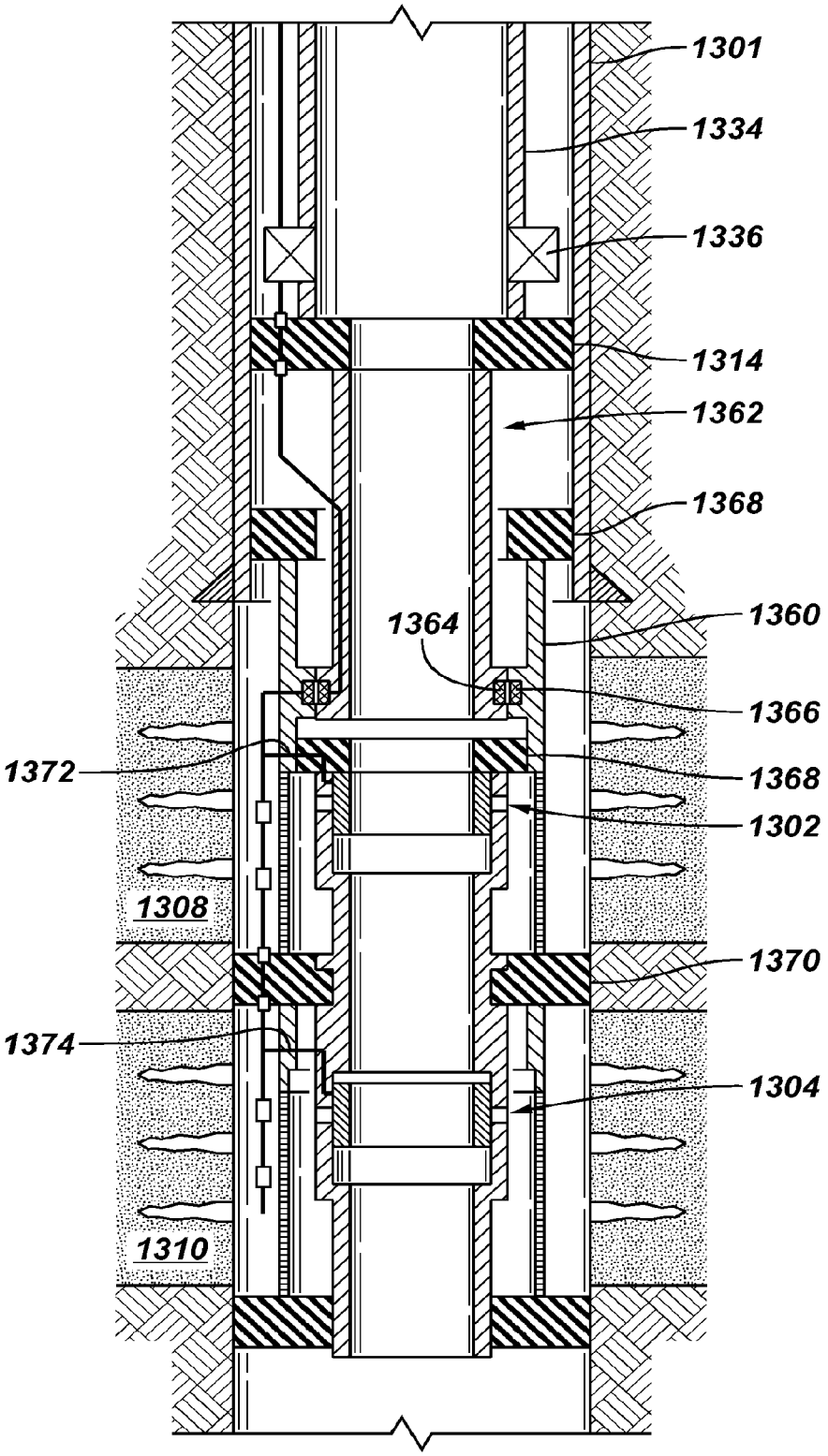

In the embodiments of FIGS. 23 and 24, flow control valves are provided as part of the upper completion section. In FIG. 25, on the other hand, the flow control valves 1302 and 1304 are provided as part of a lower completion section 1360. In the FIG. 25 embodiment, the upper completion section 1362 has a male inductive coupler portion 1364 that is able to communicate with a female inductive coupler portion 1366 that is provided as part of the lower completion section 1360. The lower completion section 1360 is attached by a screen hanger packer 1368 to casing 1301.

The inductive coupler portions 1364 and 1366 form an inductive coupler. The inductive coupler portion 1366 of the lower completion section 1362 is coupled through a controller cartridge (not shown) to a sensor cable 1368 that extends through an isolation packer 1370 that is also part of the lower completion section 1362. The isolation packer 1370 isolates the upper zone 1308 from the lower zone 1310.

The sensor cable 1368 is connected by cable segments 1372 and 1374 to respective flow control valves 1302 and 1304.

Figure 26:
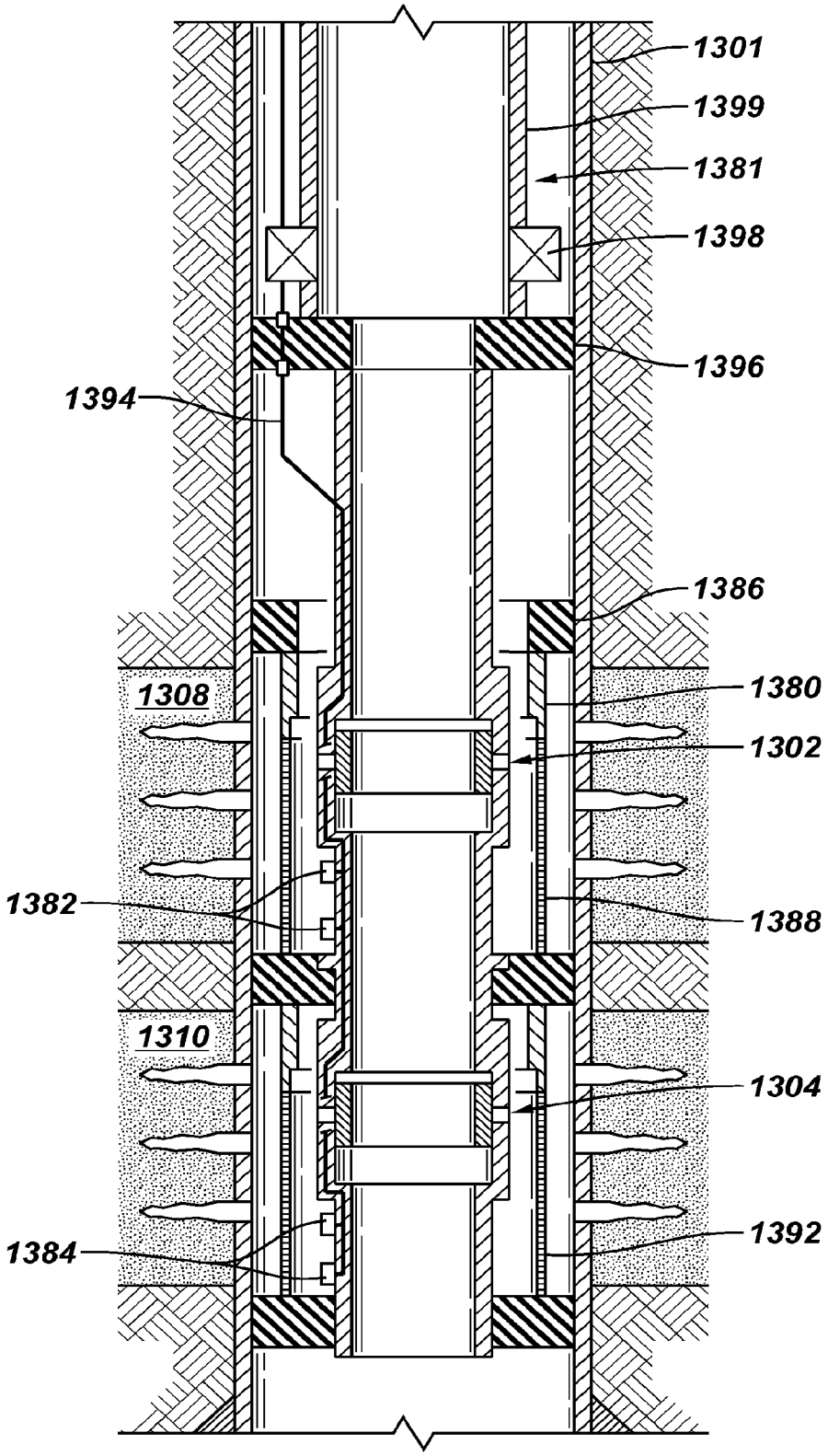
FIG. 26 illustrates another embodiment of a completion system in which an inductive coupler is not used.

FIG. 26 illustrates yet another embodiment of a completion system in which an inductive coupler is not used. The completion system of FIG. 26 includes an upper completion section 1381 and a lower completion section 1380. In this embodiment, sensors 1382 (for the upper zone 1308) and sensors 1384 (for the upper zone 1310) are part of the upper completion section 1381. The lower completion section 1380 does not include sensors or inductive couplers. The lower completion section 1380 includes a gravel pack packer 1386 connected to a sand control assembly 1388, which in turn is connected to an isolation packer 1390. The isolation packer 1390 is in turn connected to another sand control assembly 1392 for the lower zone 1310.

The sensors 1382, 1384 and flow control valves 1302, 1304 that are part of the upper completion section 1381 are connected by electric conductors (not shown) that extend to an electric cable 1394. The electric cable 1394 extends through a production packer 1396 of the upper completion section 1381 to a control station 1398. Control station 1398 is attached to tubing 1399.

Figure 27:
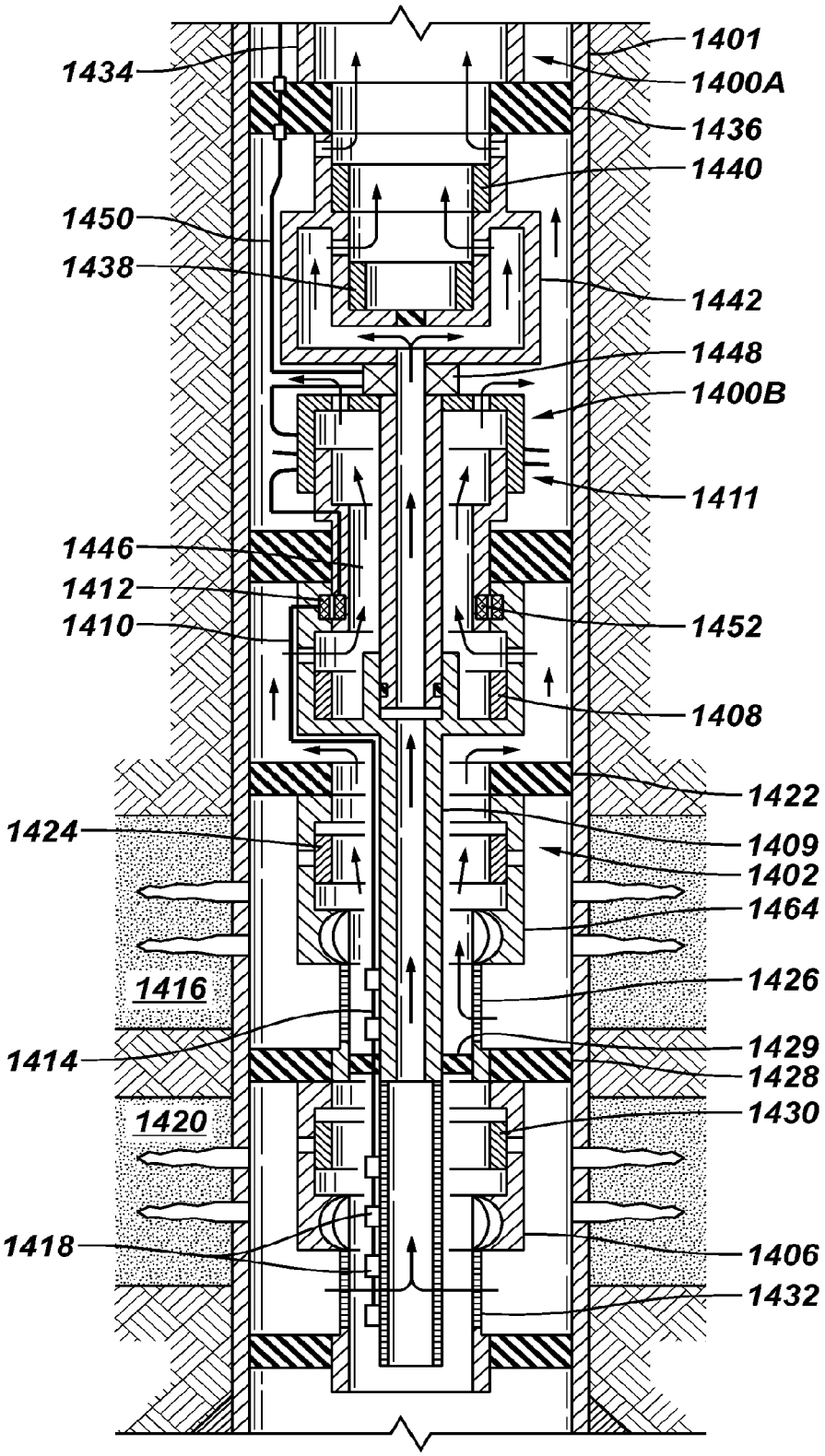

FIG. 27 shows yet another embodiment of a completion system having an upper completion section 1400A, an intermediate completion 1400B and a lower completion section 1402. The well of FIG. 27 is lined with casing 1401. In some embodiment the reservoir section may not be lined with casing but may be an open hole, an open hole with expandable screen, an open hole with stand alone screen, an open hole with slotted liner, an open hole gravel pack, or a frac-pack or resin consolidated open hole. The completion system of FIG. 27 includes formation isolation valves, including formation isolation valves 1404 and 1406 that are part of the lower completion section 1402. The lower completion section can be a single trip multi-zone or multiple trip multi-zone completion. Another formation isolation valve is an annular formation isolation valve 1408 to provide annular fluid loss control—the annular formation isolation valve 1408 is part of the intermediate completion section 1400B to provide formation isolation for the upper zone 1416 after the upper formation isolation valve 1404 is opened to insert the inner flow string 1409 inside the lower completion section 1402 In some embodiments, a formation isolation valve similar to 1404 can be run below the annular formation isolation valve 1408 as part of the intermediate completion 1400B to isolate the lower zone after the lower formation valve 1406 is opened to insert the inner flow string 1409 inside the lower zone 1420.

A sensor cable 1410 is provided as part of the intermediate completion section 1400B, and runs to a male inductive coupler portion 1452 that is also part of the upper completion section 1400A. A length compensation joint 1411 is provided between the production packer 1436 and the male inductive coupler 1452. The length compensation joint 1411 allows the upper completion to land out in the profile at the female inductive coupler portion 1412, with the production tubing or upper completion attached to the tubing hanger at the wellhead (at the top of the well). The length compensation joint 1411 includes a coiled cable to allow change in length of the cable with change in length of the compensation joint. The cable 1438 is joined to the coiled cable and the lower end of the coil is connected to the male inductive coupler 1452. The sensor cable 1410 is electrically connected to the female inductive coupler portion 1412 and runs outside of the inner flow string 1409. The sensor cable 1410 provides sensors 1414 and 1418. The cable 1410 between two zones 1416 and 1420 is fed through a seal assembly 1429. The seal assembly 1429 seals inside the packer bore or other polished bore of packer 1428.

The intermediate completion 1400B includes the female inductive coupler portion 1412, annular formation isolation valve 1408, inner flow string 1409, sensor cable 1414, and seal assembly 1429 with feed through is run on a separate trip. The inner flow string 1409, sensor cable 1414, and seal assembly 1429 are run inside (in an inner bore) the lower completion section 1402. The sensor cable 1414 provides sensors 1414 for the upper zone 1416, and sensors 1418 for the lower zone 1420.

Other components that are part of the lower completion section 1402 include a gravel pack packer 1422, a circulating port assembly 1424, a sand control assembly 1426, and isolation packer 1428. The circulating port assembly 1424, formation isolation valve 1404, and sand control assembly 1426 are provided proximate to the upper zone 1416.

The lower completion section 1402 also includes a circulating port assembly 1430 and a sand control assembly 1432, where the circulating port assembly 1430, formation isolation valve 1406, and sand control assembly 1432 are proximate to the lower zone 1420.

The upper completion section 1400A further includes a tubing 1434 that is attached to a packer 1436, which in turn is connected to a flow control assembly 1438 that has an upper flow control valve 1440 and a lower flow control valve 1442. The lower flow control valve 1442 controls fluid flow that extends through a first flow conduit 1444, whereas the upper flow control valve 1440 controls flow that extends through another flow conduit 1446. The flow conduit 1446 is in an annular flow path around the first flow conduit 1444. The flow conduit 1444 (which can include an inner bore of a pipe) receives flow from the lower zone 1420, whereas the flow conduit 1446 receives fluid flow from the upper zone 1416.

The upper completion section 1400A also includes a control station 1448 that is connected by an electric cable 1450 to the earth surface. Also, the control station 1448 is connected by electric conductors (not shown) to a male inductive coupler portion 1452, where the male inductive coupler portion 1452 and the female inductive coupler portion 1412 make up an inductive coupler.

Figure 28:
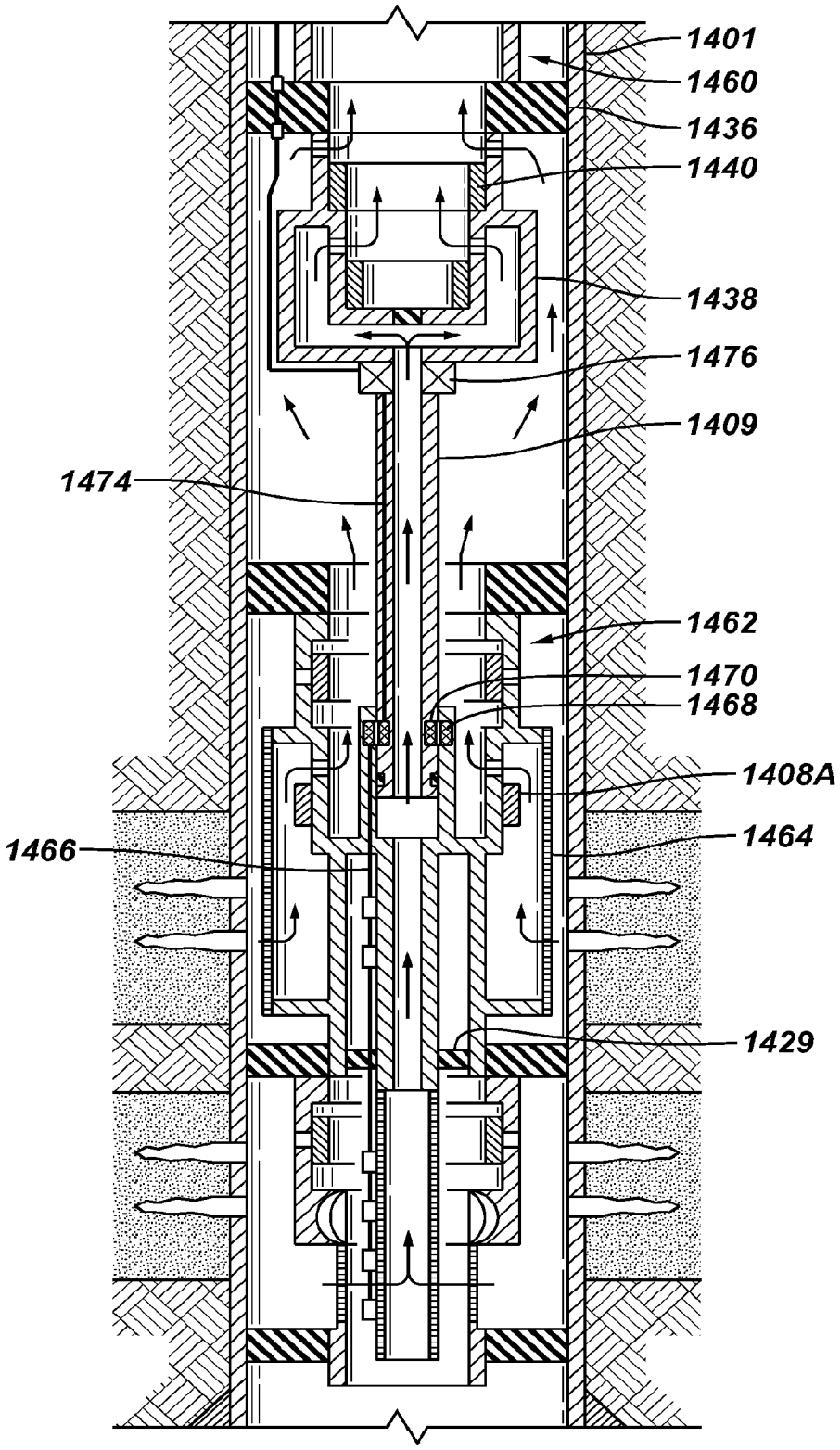

FIG. 28 shows yet another embodiment of a completion system that is a variant of the FIG. 27 embodiment that does not require an intermediate completion (1400B in FIG. 27) to deploy the annular formation isolation valve. The completion system of FIG. 28 includes an upper completion section 1460 and a lower completion section 1462. An annular formation isolation valve 1408A incorporated into a sand control assembly 1464 that is part of the lower completion section 1462.

A sensor cable 1466 extends from a female inductive coupler portion 1468. The female inductive coupler portion 1468 (which is part of the lower completion section 1462) interacts with a male inductive coupler portion 1470 to form an inductive coupler. The male inductive coupler portion 1470 is part of the inner flow string 1409 that extends from the upper completion section 1460 into the lower completion section 1462. An electric cable 1474 extends from the male inductive coupler portion 1470 to a control station 1476.

The upper completion section 1460 also includes the flow control assembly 1438 similar to that depicted in FIG. 27.

In various embodiments discussed above, various multi stage completion systems that include an upper completion section and a lower completion section and/or intermediate completion section have been discussed. In some scenarios, it may not be appropriate to provide an upper completion section after a lower completion section has been installed. This may be because of the well is suspended after the lower completion is done. In some cases, wells in the field are batch drilled and lower completions are batch completed and then suspended and then at later date upper completions are batch completed. Also in some cases it may be desirable to establish a thermal gradient across the formation for the purpose of comparison with changing temperature or other formation parameters before disturbing the formation to aid in analysis. In such cases, it may be desirable to take advantage of sensors that have already been deployed with the lower completion section of the two-stage completion system. To be able to communicate with the sensors that are part of the lower completion section, an intervention tool having a male inductive coupler portion can be lowered into the well so that the male inductive coupler portion can be placed proximate to a corresponding female inductive coupler portion that is part of the lower completion section. The inductive coupler portion of the intervention tool interacts with the inductive coupler portion of the lower completion section to form an inductive coupler that allows measurement data to be received from the sensors that are part of the lower completion section.

The measurement data can be received in real-time through the use of a communication system from the intervention tool to the surface, or the data can be stored in memory in the intervention tool and downloaded at a later time. In the case that a real-time communication is used, this could be via a wireline cable, mud-pulse telemetry, fiber-optic telemetry, wireless electromagnetic telemetry or via other telemetry procedures known in the industry. The intervention tool can be lowered on a cable, jointed pipe, or coiled tubing. The measurement data can be transmitted during an intervention process to help monitor the state of that intervention.

Figure 29:
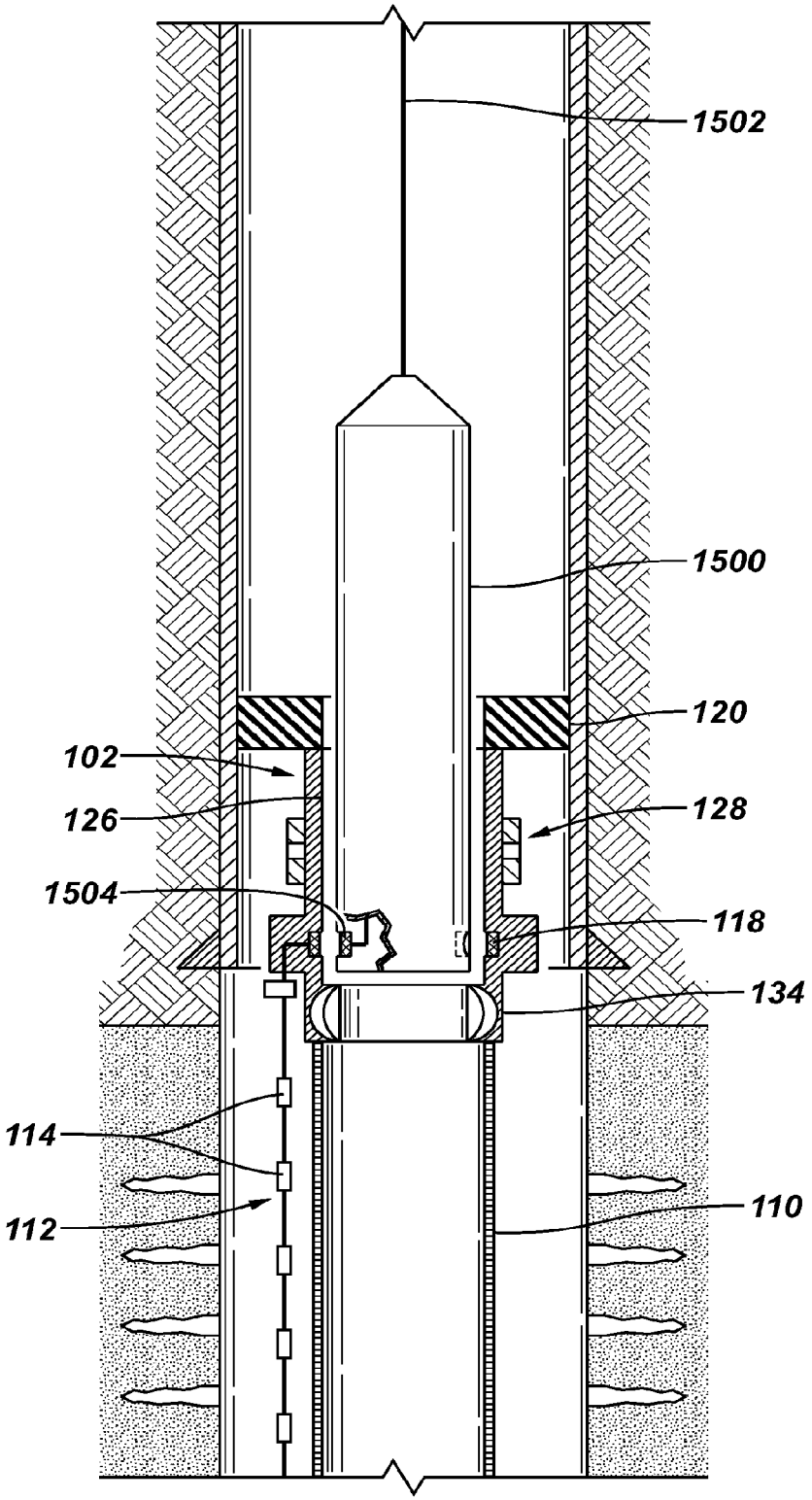
FIG. 29 illustrates an arrangement including a lower completion section and an intervention tool capable of communicating with the lower completion section using an inductive coupler, according to another embodiment.

FIG. 29 shows an example of such an arrangement. The lower completion section depicted in FIG. 29 is the same lower completion section of FIG. 2 discussed above. In the FIG. 29 arrangement, the upper completion section has not yet been deployed. Instead, an intervention tool 1500 is lowered on a carrier line 1502 into the well. The intervention tool 1500 has an inductive coupler portion 1504 that is capable of interacting with the inductive coupler portion 118 in the lower completion section 102.

The carrier line 1502 can include an electric cable or a fiber optic cable to allow communication of data received through the inductive coupler portions 118, 1504 to an earth surface location.

Alternatively, the intervention tool 1500 can include a storage device to store measurement data collected from the sensors 114 in the lower completion section 102. When the intervention tool 1500 is later retrieved to the earth surface, the data stored in the storage device can be downloaded. In this latter configuration, the invention tool 1500 can be lowered on a slickline, with the intervention tool including a battery or other power source to provide energy to enable communication through the inductive coupler portions 118, 1504 with the sensors 114.

A similar intervention-based system can also be used for coiled tubing operation. During the coiled tubing operation, it may be beneficial to collect sand face data to help decide what fluids are being pumped into the wellbore through the coiled tubing and at what rate. Measurement data collected by the sensors can be communicated in real time back to the surface by the intervention tool 1500.

In another implementation, the intervention tool 1500 can be run on a drill pipe. With a drill pipe, however, it is difficult to provide an electric cable along the drill pipe due to joints of the pipe. To address this, electric wires can be embedded within the drill pipe with coupling devices at each joint provided to achieve a wired drill pipe. Such a wired drill pipe is able to transmit data and also allow for fluid transmission through the pipe.

The intervention-based system can also be used to perform drillstem testing, with measurement data collected by the sensors 114 transmitted to the earth surface during the test to allow the well operator to analyze results of the drillstem testing.

The lower completion section 102 can also include components that can be manipulated by the intervention tool 1500, such as sliding sleeves that can be opened or closed, packers that can be set or unset, and so forth. By monitoring the measurement data collected by the sensors 114, a well operator can be provided with real-time indication of the success of the intervention (e.g., sliding sleeve closed or open, packer set or unset, etc.).

In an alternative implementation, the lower completion section 102 can include multiple female inductive coupler portions. The single male inductive coupler portion (e.g., 1504 in FIG. 29) can then be lowered into the well to allow communication with whichever female inductive coupler portion the male inductive coupler portion is positioned proximate to.

Note that the intervention tool 1500 depicted in FIG. 29 can also be used in a multilateral well that has multiple lateral braches. For example, if one of the lateral branches is producing water, the intervention tool 1500 can be used to enter the lateral branch with coil tubing to allow pumping of a flow inhibitor into the lateral branch to stop the water production. Note that surface measurements would not be able to indicate which lateral branch was producing water; only downhole measurements can perform this detection.

Each of the lateral branches of the multilateral well can be fitted with a measurement array and an inductive coupler portion. In such an arrangement, there would be no need for a permanent power source in each lateral branch. During intervention, the intervention tool can access a particular lateral branch to collect data for that lateral branch, which would provide information about the flow properties of the lateral branch. In some implementations, the sensors or the controller cartridge associated with the sensors in each lateral branch can be provided with an identifying tag or other identifier, so that the intervention tool will be able to determine which lateral branch the intervention tool has entered.

Note also that tags within the measurement system can change properties based on results of the measurement system (e.g., to change a signal if the measurement system detects significant water production). The intervention tool can be programmed to detect a particular tag, and to enter a lateral branch associated with such particular tag. This would simplify the task of knowing which lateral branch to enter for addressing a particular issue.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A sensor assembly for deployment into a well, comprising:

a sandscreen configured to prevent passage of particulate material into a completion section;

a sensor cable comprising: an outer liner made up of housing sections and sensor housing structures sealably connected to the housing sections; a plurality of spaced apart sensors inside the outer liner, wherein the sensors are spaced apart longitudinally along a length of the cable and the sensors are contained in respective sensor housing structures; and wires inside the outer liner to interconnect the plurality of sensors, wherein the sensor cable is deployed proximate to the sand screen in the well.

2. The sensor cable of claim 1, wherein the outer liner includes a continuous control line.

3. The sensor cable of claim 1, wherein the housing sections are welded to the sensor housing structures.

4. The sensor cable of claim 1, wherein each sensor includes a sensor chip and a communications interface connected to at least one of the wires.

5. The sensor cable of claim 4, wherein each sensor further includes a sensing element for sensing an environment outside the sensor cable, wherein the sensing element is electrically connected to the sensor chip.

6. The sensor cable of claim 1, further comprising a controller cartridge that is part of the liner, the controller cartridge having a processor.

7. The sensor cable of claim 1 wherein the completion section defines an annulus region between the completion section and an interior surface of the well, wherein the sensor cable is positioned between within the annulus region spaced apart from the completion section and the interior surface of the well.

8. A sensor assembly for deployment into a well, comprising:

a sandscreen configured to prevent passage of particulate material into a completion section;

a sensor cable comprising: an outer liner; a plurality of spaced apart sensors inside the outer liner, wherein the sensors are spaced apart longitudinally along a length of the cable; and wires inside the outer liner to interconnect the plurality of sensors, wherein the sensor cable is deployed proximate to the sand screen in the well and wherein each sensor includes a sensor chip and a communications interface connected to at least one of the wires.

9. The sensor cable of claim 8, wherein the outer liner includes a continuous control line.

10. The sensor cable of claim 8, wherein the liner is made up of housing sections and sensor housing structures sealably connected to the housing sections, wherein the sensors are contained in respective sensor housing structures.

11. The sensor cable of claim 10, wherein the housing sections are welded to the sensor housing structures.

12. The sensor cable of claim 8, wherein each sensor further includes a sensing element for sensing an environment outside the sensor cable, wherein the sensing element is electrically connected to the sensor chip.

13. The sensor cable of claim 8, further comprising a controller cartridge that is part of the liner, the controller cartridge having a processor.

14. The sensor cable of claim 8 wherein the completion section defines an annulus region between the completion section and an interior surface of the well, wherein the sensor cable is positioned between within the annulus region spaced apart from the completion section and the interior surface of the well.

15. A sensor assembly for deployment into a well, comprising:

a sandscreen configured to prevent passage of particulate material into a completion section;

a sensor cable comprising: an outer liner; a plurality of spaced apart sensors inside the outer liner, wherein the sensors are spaced apart longitudinally along a length of the cable;

wires inside the outer liner to interconnect the plurality of sensors, wherein the sensor cable is deployed proximate to the sand screen in the well; and a controller cartridge in communication with at least one sensor via the sensor cable, wherein the liner is made up of housing sections and sensor housing structures sealably connected to the housing sections, wherein the sensors are contained in respective sensor housing structures.

16. The sensor cable of claim 15, wherein the outer liner includes a continuous control line.

17. The sensor cable of claim 15, wherein each sensor includes a sensor chip and a communications interface connected to at least one of the wires.

18. The sensor cable of claim 17, wherein each sensor further includes a sensing element for sensing an environment outside the sensor cable, wherein the sensing element is electrically connected to the sensor chip.

19. The sensor cable of claim 15 wherein the completion section defines an annulus region between the completion section and an interior surface of the well, wherein the sensor cable is positioned between within the annulus region spaced apart from the completion section and the interior surface of the well.

20. A sensor assembly for deployment into a well, comprising:

a sandscreen configured to prevent passage of particulate material into a completion section;

a sensor cable comprising: an outer liner;

a plurality of spaced apart sensors inside the outer liner, wherein the sensors are spaced apart longitudinally along a length of the cable;

wires inside the outer liner to interconnect the plurality of sensors, wherein the sensor cable is deployed proximate to the sand screen in the well and wherein each sensor includes a sensor chip and a communications interface connected to at least one of the wires; and a controller cartridge in communication with at least one sensor via the sensor cable.

21. The sensor cable of claim 20, wherein the outer liner includes a continuous control line.

22. The sensor cable of claim 20, wherein each sensor further includes a sensing element for sensing an environment outside the sensor cable, wherein the sensing element is electrically connected to the sensor chip.

23. The sensor cable of claim 20 wherein the completion section defines an annulus region between the completion section and an interior surface of the well, wherein the sensor cable is positioned between within the annulus region spaced apart from the completion section and the interior surface of the well.

* * * * *